US009098024B2

(12) United States Patent
Ikeda et al.

(10) Patent No.: US 9,098,024 B2
(45) Date of Patent: Aug. 4, 2015

(54) COOLING DEVICE AND IMAGE FORMING APPARATUS INCLUDING SAME

(71) Applicants: Keisuke Ikeda, Kanagawa (JP); Satoshi Okano, Kanagawa (JP); Tomoyasu Hirasawa, Kanagawa (JP); Masanori Saitoh, Tokyo (JP); Takehara Kenichi, Kanagawa (JP); Hiromitsu Fujiya, Kanagawa (JP)

(72) Inventors: Keisuke Ikeda, Kanagawa (JP); Satoshi Okano, Kanagawa (JP); Tomoyasu Hirasawa, Kanagawa (JP); Masanori Saitoh, Tokyo (JP); Takehara Kenichi, Kanagawa (JP); Hiromitsu Fujiya, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/243,561

(22) Filed: Apr. 2, 2014

(65) Prior Publication Data

US 2014/0219677 A1 Aug. 7, 2014

Related U.S. Application Data

(63) Continuation of application No. 13/463,081, filed on May 3, 2012, now Pat. No. 8,725,026.

(30) Foreign Application Priority Data

Jun. 10, 2011 (JP) ..... 2011-129927
Jul. 20, 2011 (JP) ..... 2011-159165

(51) Int. Cl.
*G03G 21/00* (2006.01)
*G03G 15/20* (2006.01)
(Continued)

(52) U.S. Cl.
CPC ..... *G03G 15/2017* (2013.01); *G03G 15/0189* (2013.01); *G03G 21/206* (2013.01); *G03G 2215/0129* (2013.01)

(58) Field of Classification Search
CPC ..... G03G 21/20
USPC ..... 399/44, 91, 92, 94, 341
See application file for complete search history.

(56) References Cited

U.S. PATENT DOCUMENTS 5,970,301 A 10/1999 De Cock
2004/0131406 A1 7/2004 Ohki et al.
(Continued)

FOREIGN PATENT DOCUMENTS

JP 2002-99168 4/2002
JP 2002-99169 A 4/2002
(Continued)

OTHER PUBLICATIONS

Office Action issued Feb. 20, 2015 in Japanese Patent Application No. 2011-159165.

*Primary Examiner* — David Bolduc
*Assistant Examiner* — Barnabas Fekete
(74) *Attorney, Agent, or Firm* — Oblon, McClelland, Maier & Neustadt, L.L.P.

(57) ABSTRACT

A cooling device including at least two cooling members to cool a recording medium passing thereover, a coolant circulation unit to circulate a coolant, and tubing that connects the coolant circulation unit to the cooling members and through which the coolant circulates. Each of the cooling members includes a heat-absorbing surface that directly contacts the recording medium or indirectly contacts the recording medium via a thermal transmission member, an internal channel provided within each of the cooling members through which the coolant circulates, and a channel inlet and outlet formed at downstream and upstream ends of each of the cooling members in a direction of conveyance of the recording medium, respectively. One of an interval and a thermal insulator is provided between the cooling members.

18 Claims, 12 Drawing Sheets

(51) Int. Cl.
*G03G 15/01* (2006.01)
*G03G 21/20* (2006.01)

(56) References Cited

U.S. PATENT DOCUMENTS

| | | | | |
|---|---|---|---|---|
| 2005/0276642 | A1 | 12/2005 | Ohki et al. | |
| 2006/0039725 | A1 | 2/2006 | Wu et al. | |
| 2009/0103959 | A1 * | 4/2009 | Koyama et al. | 399/341 |

FOREIGN PATENT DOCUMENTS

| | | | |
|---|---|---|---|
| JP | 2002-229348 | | 8/2002 |
| JP | 2004-279542 | | 10/2004 |
| JP | 2005-349627 | | 12/2005 |
| JP | 2006-3819 | | 1/2006 |
| JP | 2006-58493 | | 3/2006 |
| JP | 2006-258953 | | 9/2006 |
| JP | 2008-170539 | | 7/2008 |
| JP | 4187522 | B2 | 11/2008 |
| JP | 2008-292876 | | 12/2008 |
| JP | 2010-115862 | | 5/2010 |
| JP | 4766054 | B2 | 9/2011 |
| JP | 5109410 | | 10/2012 |
| JP | 5347855 | B2 | 11/2013 |

* cited by examiner

COOLING DEVICE AND IMAGE FORMING APPARATUS INCLUDING SAME

CROSS-REFERENCE TO RELATED APPLICATIONS

This application is a continuation of U.S. application Ser. No. 13/463,081, filed May 3, 2012, and is based on and claims priority pursuant to 35 U.S.C. §119 from Japanese Patent Application Nos. 2011-129927, filed on Jun. 10, 2011 and 2011-159165, filed on Jul. 20, 2011, both in the Japan Patent Office, each of which is incorporated by reference herein in its entirety.

BACKGROUND OF THE INVENTION

1. Field of the Invention

Exemplary aspects of the present invention generally relate to a cooling device for an image forming apparatus such as a printer, a facsimile machine, and a copier, and an image forming apparatus including the cooling device.

2. Description of the Related Art

Related-art image forming apparatuses, such as copiers, printers, facsimile machines, and multifunction devices having two or more of copying, printing, and facsimile capabilities, typically form a toner image on a recording medium (e.g., a sheet of paper, etc.) according to image data using an electrophotographic method. In such a method, for example, a charger charges a surface of an image carrier (e.g., a photoconductor); an irradiating device emits a light beam onto the charged surface of the photoconductor to form an electrostatic latent image on the photoconductor according to the image data; a developing device develops the electrostatic latent image with a developer (e.g., toner) to form a toner image on the photoconductor; a transfer device transfers the toner image formed on the photoconductor onto a sheet of recording media; and a fixing device applies heat and pressure to the sheet bearing the toner image to fix the toner image onto the sheet. The sheet bearing the fixed toner image is then discharged from the image forming apparatus.

Although differing depending on types of toner and types and speed of conveyance of the sheet, the fixing device is generally controlled to have a temperature of about 180 C.° to 200 C.° so as to instantly melt toner and fix the toner image onto the sheet. Therefore, the temperature of the sheet immediately after passing through the fixing device is high, typically about 100 C.° to 130 C.° depending on the thermal capacity of each sheet such as specific heat and density. Because the melting point of toner is lower than the temperature of the sheet heated by the fixing device, the toner on the sheet is still slightly soft immediately after the sheet has passed through the fixing device, and remains adhesive until the sheet is sufficiently cooled. Consequently, in a case in which multiple sheets discharged from the fixing device are sequentially stacked one atop the other on a discharge tray during continuous image formation, such soft toner on one sheet may adhere to the next sheet, resulting in blocking and considerable image degradation.

In addition, when multiple sheets that are still warm are sequentially stacked one atop the other on the discharge tray after being discharged from the fixing device, the heat retained by the stacked sheets softens the toner on the sheets and the weight of the stacked sheets compresses the sheet and possibly causing them to stick together. If stuck sheets are forcibly separated, the toner images formed on the sheets may be damaged or destroyed. For these reasons, the sheets after the fixing process need to be sufficiently cooled.

There is known a cooling device including a single cooling member that contacts an inner circumference of an endless conveyance belt that conveys the sheet. The cooling member absorbs heat via the conveyance belt from the sheet conveyed by the conveyance belt to cool the sheet discharged from the fixing device. The sheet heated by the fixing device is cooled by the cooling member while being conveyed by the conveyance belt. Therefore, the temperature of the sheet is lowered as the sheet approaches a downstream portion of the cooling member in a direction of conveyance of the sheet.

With such a configuration, the amount of heat absorbed by the cooling member is also decreased toward the downstream portion of the cooling member. Therefore, an upstream portion of the cooling member is hotter than a downstream portion thereof. However, because a single cooling member is used to cool the sheet from upstream to downstream in the direction of conveyance of the sheet, heat from the hotter upstream portion of the cooling member is transmitted to the downstream portion. Consequently, the downstream end of the cooling member cannot be kept low, thereby degrading cooling efficiency and possibly preventing sufficient cooling of the sheet.

In another approach, an image forming apparatus includes a cooling device having a block-type cooling member provided downstream from the fixing device in the direction of conveyance of the sheet. A channel through which liquid coolant flows from downstream to upstream is formed inside the cooling member, and the cooling member contacts the sheet to cool the sheet while the sheet is conveyed past the cooling device. Thus, the sheet discharged from the fixing device is cooled by the cooling member included in the cooling device. Accordingly, toner on the sheet is also cooled and cured, thereby preventing blocking. The liquid coolant enters the cooling member from an inlet provided at a downstream end of the cooling member and flows through the channel to an outlet provided at an upstream end of the cooling member. Accordingly, the cooling member heated by heat absorbed from the sheet is cooled by the liquid coolant.

In a case in which the liquid coolant flows through the cooling member from upstream to downstream so as to cool the sheet, upstream and downstream portions of the cooling member sequentially absorb heat from the sheet. Consequently, the temperature of the liquid coolant flowing through the cooling member increases toward the downstream portion of the cooling member. As a result, a difference in temperature between the sheet and the liquid coolant flowing through the downstream portion of the cooling member also decreases, thereby degrading cooling efficiency.

By contrast, when the liquid coolant flows through the cooling member from downstream to upstream as described in the above example, the sheet can be cooled by the cooler liquid coolant at the downstream portion of the cooling member compared to the case in which the liquid coolant flows through the cooling member from upstream to downstream. As a result, the difference in temperature between the sheet and the liquid coolant flowing through the downstream portion of the cooling member can be increased, thereby efficiently cooling the sheet at the downstream portion of the cooling member.

However, again, because heat absorbed from the sheet by the upstream portion of the cooling member is transmitted to the downstream portion, the temperature of the liquid coolant flowing through the downstream portion of the cooling member is increased. Therefore, even in a configuration in which the liquid coolant flows through the cooling member from downstream to upstream, thermal transmission within the cooling member increases the temperature of the liquid coolant flowing through the downstream portion of the cooling member, thereby degrading cooling efficiency at the downstream portion of the cooling member.

BRIEF SUMMARY OF THE INVENTION

In view of the foregoing, illustrative embodiments of the present invention provide a novel cooling device using a plurality of cooling members that efficiently cool a recording medium even at a downstream end of each of the cooling members in a direction of conveyance of the recording medium. In the cooling device, the cooling members are disposed such that heat-absorbing surfaces of the respective cooling members together form a single stepless plane. Illustrative embodiments of the present invention further provide an image forming apparatus including the cooling device.

In one illustrative embodiment, a cooling device includes at least two cooling members to cool a recording medium passing thereover, a coolant circulation unit to circulate a coolant, and tubing that connects the coolant circulation unit to the cooling members and through which the coolant circulates. Each of the cooling members includes a heat-absorbing surface that directly contacts the recording medium or indirectly contacts the recording medium via a thermal transmission member, an internal channel provided within each of the cooling members through which the coolant circulates, and a channel inlet and outlet formed at downstream and upstream ends of each of the cooling members in a direction of conveyance of the recording medium, respectively. One of an interval and a thermal insulator is provided between the cooling members.

In another illustrative embodiment, an image forming apparatus includes a fixing device to fix an image formed on a recording medium onto the recording medium using heat and the cooling device described above. The cooling device is provided downstream from the fixing device in the direction of conveyance of the recording medium to cool the recording medium onto which the image is fixed by the fixing device.

In yet another illustrative embodiment, a cooling device includes an endless belt to convey a recording medium contacting an outer circumference of the belt by movement of the belt, at least two cooling members arranged side by side at an interval therebetween in a direction of movement of the belt, and a positioning member to position the cooling members flush with each other to form a single plane. The cooling members respectively include heat-absorbing surfaces each contacting an inner circumference of the belt within a range in which the outer circumference of the belt contacts the recording medium to cool the recording medium by absorbing heat from the recording medium via the belt.

In still yet another example, an image forming apparatus includes a fixing device to fix an image formed on a recording medium onto the recording medium using heat and the cooling device described above. The cooling device is provided downstream from the fixing device in a direction of conveyance of the recording medium to cool the recording medium onto which the image is fixed by the fixing device.

Additional features and advantages of the present disclosure will become more fully apparent from the following detailed description of illustrative embodiments, the accompanying drawings, and the associated claims.

BRIEF DESCRIPTION OF THE DRAWINGS

A more complete appreciation of the disclosure and many of the attendant advantages thereof will be more readily obtained as the same becomes better understood by reference to the following detailed description of illustrative embodiments when considered in connection with the accompanying drawings, wherein:

FIG. 5(*b*) is a graph showing temperature distribution corresponding to the configuration illustrated in FIG. 5(*a*);

FIG. 6(*b*) is a side view illustrating the configuration of the two separate cooling plates provided to the cooling device according to the first illustrative embodiment;

FIG. 6(*c*) is a graph showing temperature distribution corresponding to the configurations respectively illustrated in FIGS. 6(*a*) and 6(*b*);

FIG. 9(*b*) is a graph showing temperature distribution corresponding to the configuration illustrated in FIG. 9(*a*);

DETAILED DESCRIPTION OF ILLUSTRATIVE EMBODIMENTS

Figure 1:
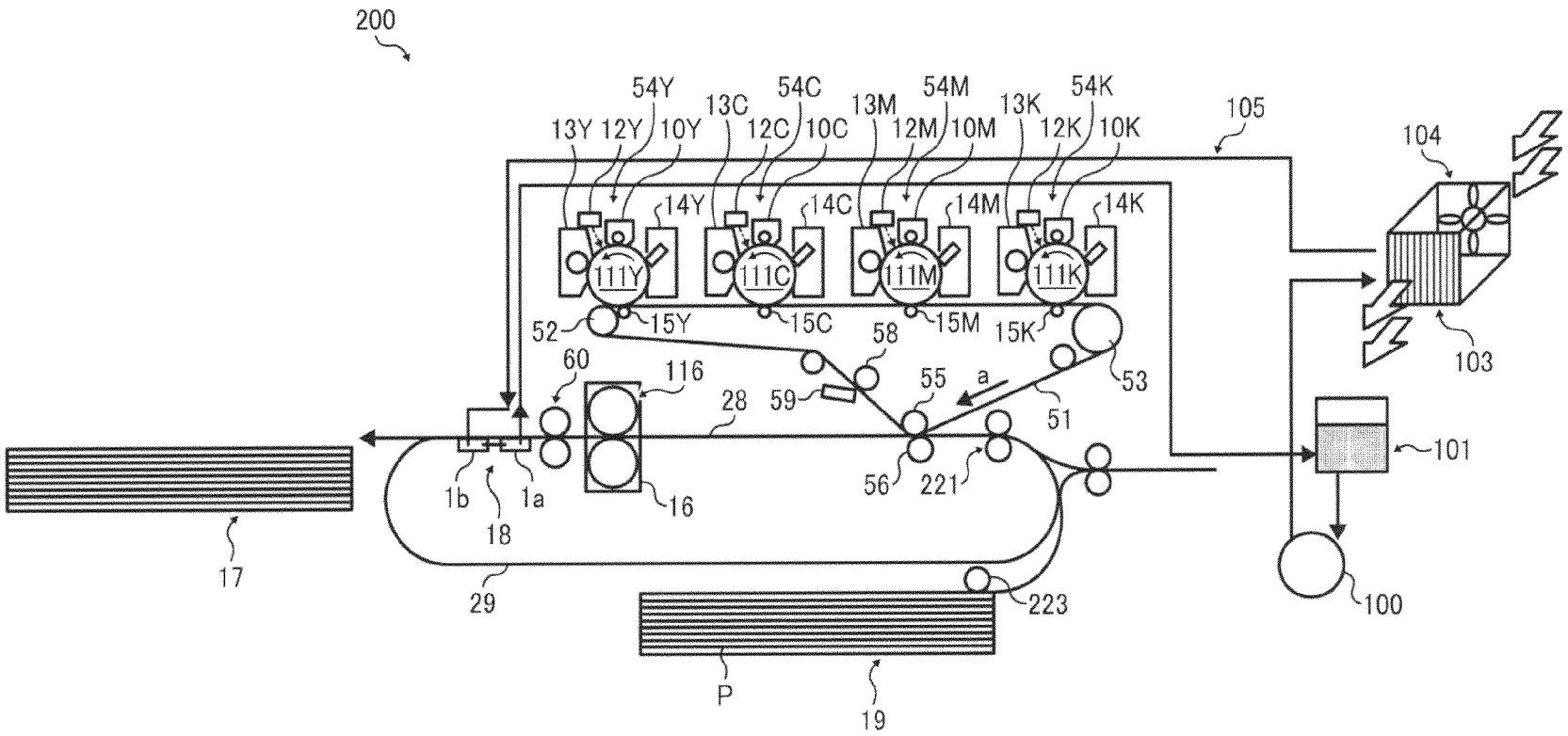
FIG. 1 is a schematic vertical cross-sectional view illustrating an example of a configuration of a tandem-type full-color image forming apparatus employing an intermediate transfer belt system, in which a cooling device according to illustrative embodiments is installed.

In describing illustrative embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Illustrative embodiments of the present invention are now described below with reference to the accompanying drawings.

In a later-described comparative example, illustrative embodiment, and exemplary variation, for the sake of simplicity the same reference numerals will be given to identical constituent elements such as parts and materials having the same functions, and redundant descriptions thereof omitted unless otherwise required.

FIG. 1 is a schematic vertical cross-sectional view illustrating an example of a configuration of a tandem-type full-color image forming apparatus 200 employing an intermediate transfer belt system, in which a cooling device 18 according to illustrative embodiments is included.

It is to be noted that the cooling device 18 is applicable to any device in which cooling of a sheet-type member is needed as well as to image forming apparatuses. In addition, although liquid is used as a coolant in illustrative embodiments, the coolant is not limited thereto but may be any fluid, such as air.

The image forming apparatus 200 includes an intermediate transfer belt 51 wound around multiple rollers such as first, second, and third rollers 52, 53, and 55. The intermediate transfer belt 51 is rotated by rotation of the rollers 52, 53, and 55 in a clockwise direction as indicated by an arrow a in FIG. 1, and processing units for image formation are disposed around the intermediate transfer belt 51.

Part of the processing units, that is, image forming units 54Y, 54C, 54M, and 54K (hereinafter collectively referred to as image forming units 54), are disposed above the intermediate transfer belt 51 between the first and second rollers 52 and 53, in that order from upstream to downstream in the direction of rotation of the intermediate transfer belt 51. Taking the image forming unit 54Y as a representative example, a charger 10Y, an optical writing device 12Y, a developing device 13Y, and a cleaning device 14Y are provided around a drum-type photoconductor 111Y. The image forming unit 54Y further includes a primary transfer roller 15Y provided opposite the photoconductor 111Y with the intermediate transfer belt 51 interposed therebetween. It is to be noted that, the other three image forming units 54C, 54M, and 54K have the same configuration as the image forming unit 54Y, only differing in color of toner used. The image forming units 54 are arranged side by side at predetermined intervals.

Although each of optical writing devices 12Y, 12C, 12M, and 12K (hereinafter collectively referred to as optical writing devices 12) includes an LED as a light source, alternatively, a semiconductor laser may be used as the light source. The optical writing devices 12 irradiate photoconductors 111Y, 111C, 111M, and 111K (hereinafter collectively referred to as photoconductors 111) with light based on image data, respectively.

The image forming apparatus 200 further includes a sheet storage 19 that stores a sheet-type member such as a sheet P, a sheet feed roller 223, a pair of registration rollers 221, a secondary transfer roller 56, a belt cleaning device 59, a thermal fixing device 16, the cooling device 18, and a discharge storage 17, each of which is disposed below the intermediate transfer belt 51. The secondary transfer roller 56 is disposed opposite the third roller 55 with the intermediate transfer belt 51 interposed therebetween to transfer a toner image from the intermediate transfer belt 51 onto the sheet P. The belt cleaning device 59 that contacts an outer surface of the intermediate transfer belt 51 is provided opposite a roller 58 that contacts an inner surface of the intermediate transfer belt 51 so as to clean the outer surface of the intermediate transfer belt 51. The cooling device 18 includes cooling plates 1*a* and 1*b*, both of which cool the sheet P. The sheet P having a fixed toner image thereon is discharged to the discharge storage 17. A sheet conveyance path 28 is extended within the image forming apparatus 200 from the sheet storage 19 to the discharge storage 17. The image forming apparatus 200 further includes a sheet conveyance path 29 for duplex image formation that reverses the sheet P conveyed from the cooling device 18 and further conveys the sheet P to the pair of registration rollers 221 again when an image is formed also on a back side of the sheet P during duplex image formation.

The cooling device 18 includes the cooling plates 1*a* and 1*b*, a pump 100, a tank 101, a radiator 103, and a cooling fan 104. Each of the cooling plates 1*a* and 1*b* is a heat absorber that absorbs heat from the sheet P. The tank 101 is a storage device that stores a liquid coolant. Tubing 105 consisting of subsections 105*a*-105*c* is connected to an inlet and outlet provided to each of the cooling plates 1*a* and 1*b*, and connects the cooling plates 1*a* and 1*b*, the radiator 103, the tank 101, and the pump 100 so that the liquid coolant is circulated in the cooling device 18. The pump 100 is a coolant circulation unit that conveys the liquid coolant stored in the tank 101 through the tubing 105. The radiator 103 is a heat releasing part that releases heat absorbed from the sheet P by the liquid coolant via the cooling plates 1*a* and 1*b* outside the image forming apparatus 200. The cooling fan 104 is an air generator mounted on the radiator 103 to generate air flow around the radiator 103 to cool the radiator 103.

As indicated by solid arrows in FIG. 1 each representing the tubing 105, the liquid coolant cooled by the radiator 103 is supplied to the cooling plates 1*b* and 1*a*, flows through the cooling plates 1*b* and 1*a*, and then is discharged from the cooling plates 1*b* and 1*a*. The liquid coolant thus discharged is conveyed to the tank 101 and the pump 100 and is returned to the radiator 103 again to be cooled. The liquid coolant is circulated by rotational pressure from the pump 100, and heat is released from the liquid coolant by the radiator 103, which in turn cools the cooling plates 1*a* and 1*b*. The capacity of the pump 100 to convey the liquid coolant and the size of the radiator 103 are determined by thermal design considerations such as an amount of cooling required of the cooling plates 1*a* and 1*b*.

Taking the image forming unit 54Y as a representative example, image forming processes performed in the image forming apparatus 200 are described in detail below. In the same way as the general electrophotographic method, first, the surface of the photoconductor 111Y is evenly charged by the charger 10Y. The optical writing unit 12Y irradiates the charged surface of the photoconductor 111Y with light to form an electrostatic latent image on the surface of the photoconductor 111Y. Then, the developing device 13Y develops the electrostatic latent image with toner so that a toner image is formed on the surface of the photoconductor 111Y. The toner image is then primarily transferred from the surface of the photoconductor 111Y onto the intermediate transfer belt 51 by the primary transfer roller 15Y to which a transfer bias is supplied. Thereafter, the surface of the photoconductor 111Y is cleaned by the cleaning device 14Y. The above-described image forming processes are also performed in the other three image forming units 54C, 54M, and 54K, differing only the color of toner used.

Developing devices 13Y, 13C, 13M, and 13K (hereinafter collectively referred to as developing devices 13) included in the respective image forming units 54 develop electrostatic latent images formed on the surfaces of the photoconductors 111 with toner of specific colors, that is, yellow (Y), cyan (C), magenta (M), and black (K), respectively. Thus, a full-color toner image is formed using the four image forming units 54. Specifically, the toner images formed on the surfaces of the photoconductors 111 are sequentially transferred onto the intermediate transfer belt 51 one atop the other by primary transfer rollers 15Y, 15C, 15M, and 15K (hereinafter collectively referred to as primary transfer rollers 15), each supplied with a transfer bias and provided opposite the respective photoconductors 111 with the intermediate transfer belt 51 interposed therebetween. Accordingly, a single full-color toner image is formed on the intermediate transfer belt 51.

The full-color toner image formed on the intermediate transfer belt 51 is secondarily transferred onto the sheet P by the secondary transfer roller 56. The intermediate transfer belt 51 is then cleaned by the belt cleaning device 59. A transfer bias is supplied to the secondary transfer roller 56 to form a transfer electric field between the secondary transfer roller 56 and the third roller 55 with the intermediate transfer belt 51 interposed therebetween. Thus, the full-color toner image formed on the intermediate transfer belt 51 is secondarily transferred from the intermediate transfer belt 51 onto the sheet P conveyed to a nip formed between the secondary transfer roller 56 and the intermediate transfer belt 51. After secondary transfer of the full-color toner image from the intermediate transfer belt 51 onto the sheet P, the sheet P having the full-color toner image thereon is conveyed to the fixing device 16 to fix the full-color toner image to the sheet P. Then, the sheet P having the fixed full-color image thereon is discharged to the discharge storage 17.

In the image forming apparatus 200 according to illustrative embodiments, before being discharged to the discharge storage 17, the sheet P having the fixed image thereon passes the cooling device 18 disposed immediately after the fixing device 16. When passing the cooling device 18, the sheet P heated by the fixing device 16 contacts the cooling plates 1*a* and 1*b*. At this time, heat is absorbed from the sheet P by heat-absorbing surfaces of the cooling plates 1*a* and 1*b* that face the sheet P. The heat thus absorbed by the cooling plates 1*a* and 1*b* is transmitted to the liquid coolant flowing through the cooling plates 1*a* and 1*b*. The liquid coolant heated by the heat transmitted from the cooling plates 1*a* and 1*b* is then discharged from the cooling plates 1*a* and 1*b* to be conveyed to the radiator 103 having the cooling fan 104 via the tank 101 and the pump 100. The heat released from the liquid coolant by the radiator 103 is discharged outside the image forming apparatus 200. After the heat is released from the liquid coolant by the radiator 103 and the temperature of the liquid coolant is lowered to room temperature, the liquid coolant is conveyed to the cooling plates 1*b* and 1*a* again. The above-described heat releasing cycle having good cooling capability using the liquid coolant can efficiently cool the sheet P heated by the fixing device 16.

As a result, when the sheet P is stored in the discharge storage 17, toner on the sheet securely hardens and is fixed onto the sheet P. In particular, blocking, which tends to occur during duplex image formation in which the fixing device 16 performs the fixing process twice for each sheet P, can be reliably prevented by use of the cooling device 18.

Figure 2:
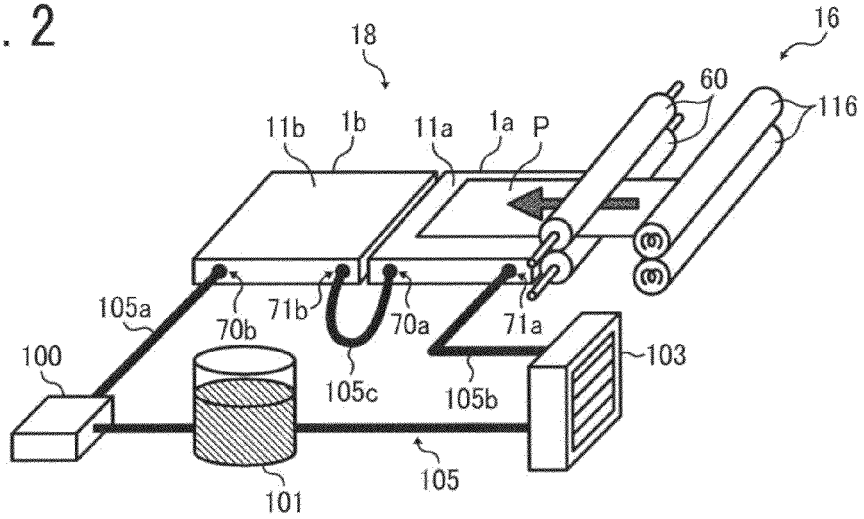
FIG. 2 is schematic view illustrating an example of an overall configuration of a cooling device according to a first illustrative embodiment.

FIG. 2 is a schematic view illustrating an example of an overall configuration of the cooling device 18 according to the first illustrative embodiment.

In the first illustrative embodiment, the pump 100, the radiator 103, the tank 101, and cooling members, which, in the present illustrative embodiment, are the cooling plates 1*a* and 1*b*, are connected to one another by the tubing 105 constructed of rubber tubes. A serpentine liquid circulation channel is formed within each of the cooling plates 1*a* and 1*b*.

Figure 3:
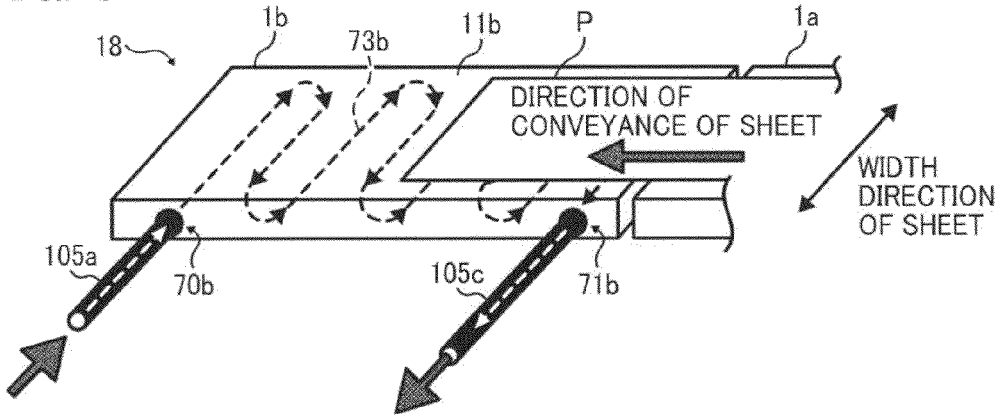
FIG. 3 is a schematic view illustrating an example of a configuration around one of cooling plates included in the cooling device.

FIG. 3 is a schematic view illustrating an example of a configuration around the cooling plate 1*b* in the cooling device 18 according to the first illustrative embodiment.

An inlet 70*b* from which the liquid coolant enters the cooling plate 1*b* is provided at a downstream end on a lateral surface of the cooling plate 1*b* in a direction of conveyance of the sheet P. An outlet 71*b* from which the liquid coolant is discharged from the cooling plate 1*b* is provided at an upstream end on the lateral surface of the cooling plate 1*b*. The inlet 70*b* and outlet 71*b* of the cooling plate 1*b* are connected to respective ends of a serpentine internal channel 73*b* formed within the cooling plate 1*b* in a width direction of the sheet P perpendicular to the direction of conveyance of the sheet P. One end of a tube 105*a* is connected to the pump 100, and the other end thereof is connected to the inlet 70*b*. One end of a tube 105*c* is connected to the outlet 71*b*.

Figure 4:
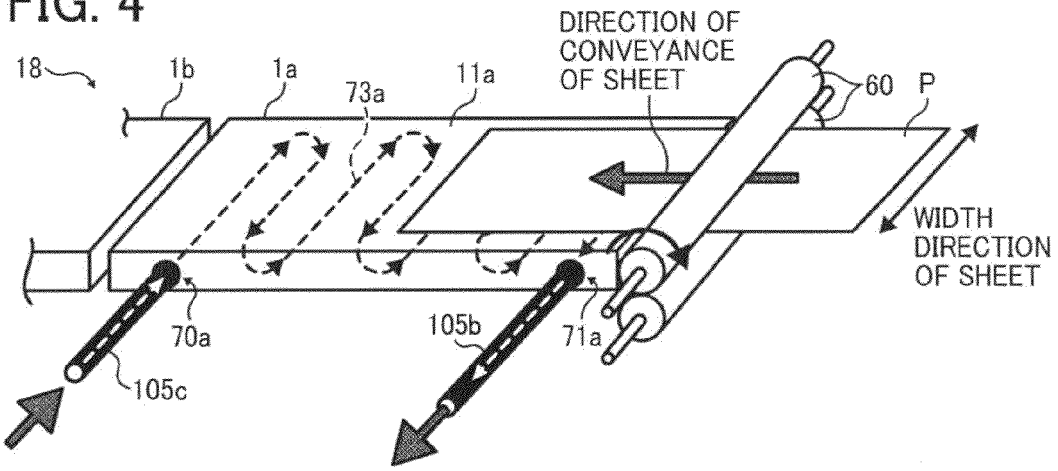
FIG. 4 is a schematic view illustrating an example of a configuration around the other one of the cooling plates included in the cooling device.

FIG. 4 is a schematic view illustrating an example of a configuration around the cooling plate 1*a* in the cooling device 18 according to the first illustrative embodiment.

An inlet 70*a* from which the liquid coolant enters the cooling plate 1*a* is provided at a downstream end on a lateral surface of the cooling plate 1*a* in the direction of conveyance of the sheet P. An outlet 71*a* from which the liquid coolant is discharged from the cooling plate 1*a* is provided at an upstream end on the lateral surface of the cooling plate 1*a*. The inlet 70*a* and outlet 71*a* of the cooling plate 1*a* are connected to respective ends of a serpentine internal channel 73*a* formed within the cooling plate 1*a* in the width direction of the sheet P. The one end of the tube 105*c* is connected to the outlet 71*b* of the cooling plate 1*b*, and the other end thereof is connected to the inlet 70*a* of the cooling plate 1*a*. One end of a tube 105*b* is connected to the radiator 103, and the other end thereof is connected to the outlet 71*a*.

Thus, the inlet 70*a* and outlet 71*a* are provided on the same lateral surface of the cooling plate 1*a*, and the inlet 70*b* and outlet 71*b* are provided on the same lateral surface of the cooling plate 1*b*. Accordingly, all the tubes 105*a*, 105*b*, and 105*c* can be disposed on one side of the cooling plates 1*a* and 1*b* in the width direction of the sheet P, thereby simplifying placement of the tubing 105 within the cooling device 18 and achieving a space-saving configuration.

The liquid coolant stored in the tank 101 is conveyed by the pump 100 so as to enter the cooling plate 1*b* from the inlet 70*b* via the tube 105*a*. The liquid coolant absorbs heat while flowing through the cooling plate 1*b*, and is discharged from the cooling plate 1*b* to the tube 105*c* via the outlet 71*b*. The liquid coolant thus discharged then enters the cooling plate 1*a* from the inlet 70*a* via the tube 105*c*. The liquid coolant absorbs heat while flowing through the cooling plate 1*a*, and is discharged from the cooling plate 1*a* to the tube 105*b* via the outlet 71*a*. The liquid coolant heated by heat absorbed from the cooling plates 1*a* and 1*b* while flowing through the cooling plates 1*a* and 1*b* is then conveyed to the radiator 103 so that the heat is released from the liquid coolant. Thereafter, the liquid coolant sufficiently cooled by the radiator 103 is returned to the tank 101.

The fixing device 16 includes a pair of heat rollers 116 having a heater therein. The full-color toner image is fixed to the sheet P by heat supplied from the pair of heat rollers 116. The sheet P thus heated is conveyed by a pair of conveyance rollers 60 to the cooling device 18. In the cooling device 18, the sheet P contacts an upper surface of each of the cooling plates 1*a* and 1*b*, that is, heat-absorbing surfaces 11*a* and 11*b*, while being conveyed. At this time, the cooling plates 1*a* and 1*b* absorb heat from the sheet P contacting the heat-absorbing surfaces 11*a* and 11*b* using thermal transmission to cool the sheet P.

Figure 5:
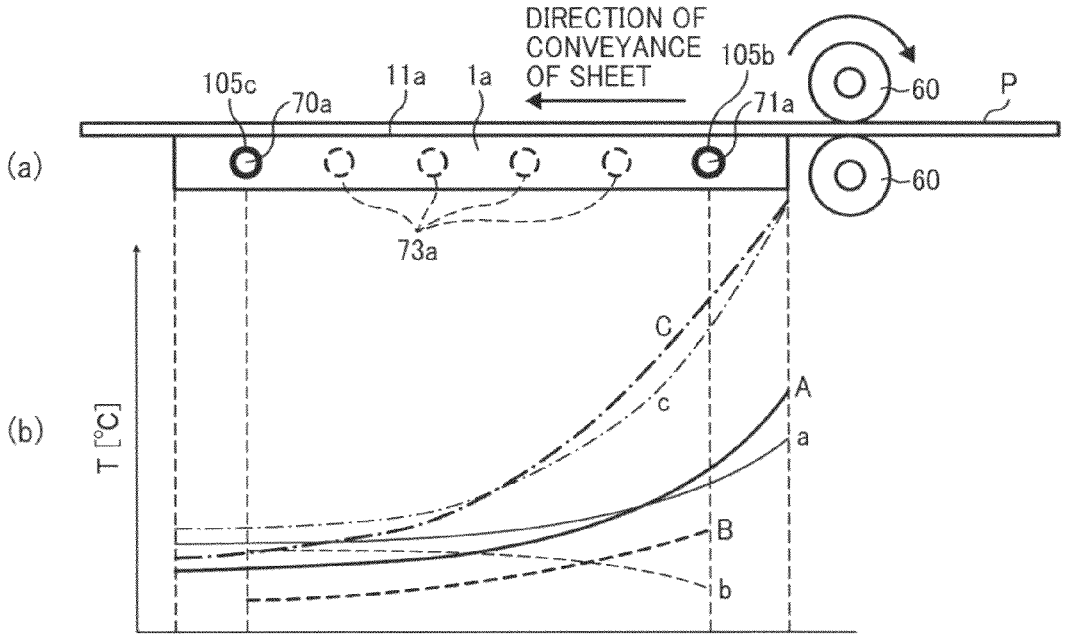
FIG. 5(*a*) is a side view illustrating the configuration around the cooling plate.

FIG. 5(*a*) is a side view illustrating the configuration around the cooling plate 1*a*, and FIG. 5(*b*) is a graph showing temperature distribution in the direction of conveyance of the sheet P corresponding to the configuration illustrated in FIG. 5(*a*). It is to be noted that, in the graph shown in FIG. 5(*b*), the horizontal axis represents position in the direction of conveyance of the sheet P and the vertical axis represents temperature.

The sheet P heated by the pair of heat rollers 116 is conveyed by the pair of conveyance rollers 60 to the cooling plate 1*a* so that the sheet P is cooled by the cooling plate 1*a* while contacting the heat-absorbing surface 11*a* of the cooling plate 1*a*. Accordingly, temperature distribution in the direction of conveyance of the sheet P occurs in the cooling plate 1*a* that absorbs heat from the sheet P.

Each of bold lines A, B, and C in FIG. 5(*b*) indicates temperature distribution in the case of the first illustrative embodiment as described above, in which the liquid coolant enters the cooling plate 1*a* from the inlet 70*a*, flows through the cooling plate 1*a* through the internal channel 73*a*, and then is discharged from the cooling plate 1*a* via the outlet 71*a*. In other words, the liquid coolant flows through the cooling plate 1*a* from downstream to upstream in the direction of conveyance of the sheet P.

The bold solid line A in FIG. 5(*b*) indicates temperature distribution in the cooling plate 1*a* in the direction of conveyance of the sheet P. The bold broken line B in FIG. 5(*b*) indicates temperature distribution in the liquid coolant flowing through the cooling plate 1*a* in the direction of conveyance of the sheet P. The bold broken line C in FIG. 5(*b*) indicates temperature distribution in the sheet P in the direction of conveyance thereof.

Meanwhile, each of fine lines a, b, and c in FIG. 5(*b*) indicates temperature distribution in a configuration according to a comparative example, in which the liquid coolant enters the cooling plate 1*a* from the outlet 71*a*, flows through the cooling plate 1*a* through the internal channel 73*a*, and is then discharged from the cooling plate 1*a* via the inlet 70*a*. Thus, in the comparative example, the liquid coolant flows through the cooling plate 1*a* from upstream to downstream in the direction of conveyance of the sheet P, which is the reverse of the configuration employed in the first illustrative embodiment.

The fine solid line a in FIG. 5(*b*) indicates temperature distribution in the cooling plate 1*a* in the direction of conveyance of the sheet P according to the comparative example. The fine broken line b in FIG. 5(*b*) indicates temperature distribution in the liquid coolant flowing through the cooling plate 1*a* in the direction of conveyance of the sheet P according to the comparative example. The fine broken line c in FIG. 5(*b*) indicates temperature distribution in the sheet P in the direction of conveyance thereof according to the comparative example.

As is clear from FIG. 5(*b*), at the upstream end of the cooling plate 1*a*, the temperature of the cooling plate 1*a* according to the first illustrative embodiment indicated by the bold solid line A is higher than that according to the comparative example indicated by the fine solid line a. By contrast, at the downstream end of the cooling plate 1*a*, the temperature of the cooling plate 1*a* according to the first illustrative embodiment is lower than that according to the comparative example. The above difference in temperature distribution in the cooling plate 1*a* between the first illustrative embodiment and the comparative example reflects the temperature of the liquid coolant flowing through the cooling plate 1*a*.

When the liquid coolant enters the cooling plate 1*a* from the inlet 70*a* provided at the downstream end of the cooling plate 1*a*, liquid coolant at its coolest flows around the downstream end of the cooling plate 1*a* as indicated by the bold broken line B. Then, the liquid coolant absorbs heat while flowing through the cooling plate 1*a* from downstream to upstream so that the temperature of the liquid coolant is gradually increased toward the upstream end of the cooling plate 1*a*. When hottest, the liquid coolant is discharged from the outlet 71*a* provided at the upstream end of the cooling plate 1*a*.

By contrast, when the liquid coolant enters the cooling plate 1*a* from the outlet 71*a* provided at the upstream end of the cooling plate 1*a*, liquid coolant at its coolest flows around the upstream end of the cooling plate 1*a* as indicated by the fine broken line b. Then, the liquid coolant absorbs heat while flowing through the cooling plate 71*a* from upstream to downstream so that the temperature of the liquid coolant is gradually increased toward the downstream end of the cooling plate 71*a*. When hottest, the liquid coolant is discharged from the inlet 70*a* provided at the downstream end of the cooling plate 1*a*.

Thus, in the case of the first illustrative embodiment, in which the liquid coolant flows through the cooling plate 1*a* from downstream to upstream, the downstream end of the cooling plate 1*a* has a lower temperature and the upstream end thereof has a higher temperature compared to the case of the comparative example, in which the liquid coolant flows through the cooling plate 1*a* from upstream to downstream.

The above difference in temperature distribution in the cooling plate 1*a* between the first illustrative embodiment and the comparative example affects cooling efficiency. Comparing the bold broken line C to the fine broken line c, at the upstream portion of the cooling plate 1*a*, that is, at the start of cooling of the sheet P, the temperature of the sheet P according to the comparative example indicated by the fine broken line c is lower than that according to the first illustrative embodiment indicated by the bold broken line C. However, at the downstream portion of the cooling plate 1*a*, that is, at the end of cooling of the sheet P, a temperature of the sheet P according to the first illustrative embodiment is lower than that according to the comparative example. The reason for the lower temperature of the sheet P at the downstream portion of the cooling plate 1*a* according to the first illustrative embodiment is that the sheet P contacts a portion of the heat-absorbing surface 11*a* having the lower temperature at the downstream end of the cooling plate 1*a*.

In order to prevent blocking, the sheet P needs to be cooled as low as possible by the cooling device 18 before being discharged to the discharge storage 17. Therefore, it is preferable that the downstream end of the cooling plate 1*a*, which cools the sheet P in the last stage of cooling operation performed by the cooling plate 1*a*, have a lower temperature even if the upstream end of the cooling plate 1*a* has a rather higher temperature.

Thus, in the first illustrative embodiment, the liquid coolant enters the cooling plate 1*a* from the inlet 70*a* provided at the downstream end of the cooling plate 1*a* and flows through the cooling plate 1*a* through the internal channel 73*a* in a direction opposite the direction of conveyance of the sheet P. Thereafter, the liquid coolant is discharged from the cooling plate 1*a* via the outlet 71*a* provided at the upstream end of the cooling plate 1*a*. As a result, a decrease in cooling efficiency at the downstream end of the cooling plate 1*a* can be prevented, thereby efficiently cooling the sheet P.

In the first illustrative embodiment, in a manner similar to the cooling plate 1*a*, the liquid coolant enters the cooling plate 1*b* from the inlet 70*b* provided at the downstream end of the cooling plate 1*b* and flows through the cooling plate 1*b* through the internal channel 73*b* in the direction opposite the direction of conveyance of the sheet P. Thereafter, the liquid coolant is discharged from the cooling plate 1*b* via the outlet 71*b* provided at the upstream end of the cooling plate 1*b*. As a result, a decrease in cooling efficiency at the downstream end of the cooling plate 1*b* can be also prevented, thereby efficiently cooling the sheet P.

Because the fixing device 16 melts the toner by heat from the pair of heat rollers 116 to fix the toner image to the sheet P, moisture contained in the sheet P is evaporated, resulting in an increase in humidity around the fixing device 16. Consequently, if the upstream end of the cooling plate 1*a* provided near the pair of heat rollers 116 is too cool, a difference in temperature between the cooling plate 1*a* and the pair of heat rollers 116 is increased too much, thereby easily causing condensation on the surface of the cooling plate 1*a* at the upstream end thereof.

By contrast, when the liquid coolant flows through the cooling plate 1*a* from downstream to upstream as in the case of the first illustrative embodiment, the temperature at the upstream end of the cooling plate 1*a* is increased, thereby reducing the difference in temperature between the pair of heat rollers 116 and the cooling plate 1*a*. Accordingly, condensation on the surface of the cooling plate 1*a* at the upstream end thereof can be prevented.

In addition, the split configuration incorporating an interval between the cooling plates 1*a* and 1*b* provides further cooling efficiency, particularly compared to a configuration employing a single continuous cooling plate, as is described below with reference to FIG. 6.

Figure 6:
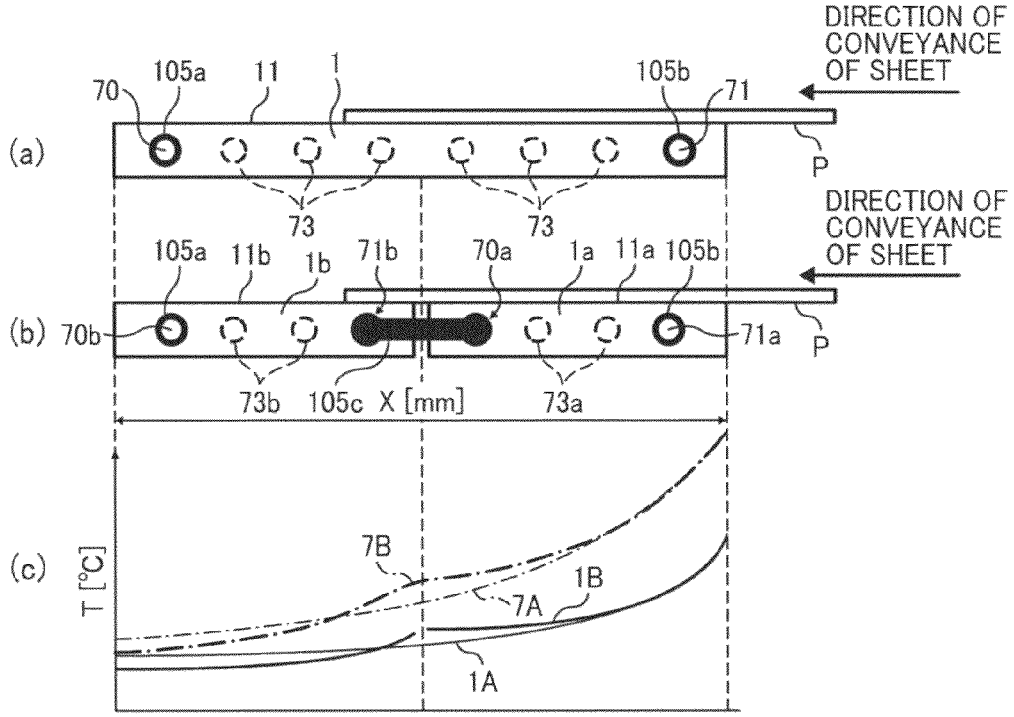
FIG. 6(*a*) is a side view illustrating an example of a configuration of a single cooling plate provided to a cooling device according to a comparative example.

FIG. 6(*a*) is a side view illustrating an example of a configuration of a single cooling plate 1 provided to a cooling device according to a second comparative example. The cooling plate 1 has a length of X mm in the direction of conveyance of the sheet P. FIG. 6(*b*) is a side view illustrating the configuration of the cooling plates 1*a* and 1*b* arranged side by side at an interval therebetween in the direction of conveyance of the sheet P according to the first illustrative embodiment. The cooling plates 1*a* and 1*b* are respectively disposed in two separate ranges obtained by dividing a single range having the length of X mm into the two ranges. FIG. 6(*c*) is a graph showing temperature distribution corresponding to the configurations respectively illustrated in FIGS. 6(*a*) and 6(*b*). It is to be noted that in the graph shown in FIG. 6(*c*), the horizontal axis represents position in the direction of conveyance of the sheet P and the vertical axis represents temperature.

In the case of the second comparative example in which the single cooling plate 1 is provided as illustrated in FIG. 6(*a*), the liquid coolant enters the cooling plate 1 from an inlet 70 provided at a downstream end on a lateral surface of the cooling plate 1, flows through the cooling plate 1 through an internal channel 73, and is then discharged from the cooling plate 1 via an outlet 71 provided at an upstream end on the lateral surface of the cooling plate 1.

In the case of the first illustrative embodiment, in which the two separate cooling plates 1*a* and 1*b* are provided side by side at an interval therebetween in the direction of conveyance of the sheet P as illustrated in FIG. 6(*b*), first, the liquid coolant enters the cooling plate 1*b* from the inlet 70*b* provided at the downstream end of the cooling plate 1*b*, flows through the cooling plate 1*b* through the internal channel 73*b*, and is then discharged from the cooling plate 1*b* via the outlet 71*b* provided at the upstream end of the cooling plate 1*b* to the tube 105*c*. Next, the liquid coolant discharged to the tube 105*c* enters the cooling plate 1*a* from the inlet 70*a* provided at the downstream end of the cooling plate 1*a*, flows through the cooling plate 1*a* through the internal channel 73*a*, and is then discharged from the cooling plate 1*a* via the outlet 71*a* provided at the upstream end of the cooling plate 1*a* to the tube 105*b*.

Fine lines 1A and 7A in FIG. 6(*c*) indicate temperature distribution in the case of the second comparative example in which the single cooling plate 1 is provided as illustrated in FIG. 6(*a*). Specifically, the fine solid line 1A indicates temperature distribution in the cooling plate 1 in the direction of conveyance of the sheet P. The fine broken line 7A indicates temperature distribution in the sheet P in the direction of conveyance thereof.

Bold lines 1B and 7B in FIG. 6(*c*) indicate temperature distribution in the case of the first illustrative embodiment in which the cooling plates 1*a* and 1*b* are arranged side by side at an interval therebetween in the direction of conveyance of the sheet P as illustrated in FIG. 6(*b*). Specifically, the bold solid line 1B indicates temperature distribution in the cooling plates 1*a* and 1*b* in the direction of conveyance of the sheet P. The bold broken line 7B indicates temperature distribution in the sheet P in the direction of conveyance thereof.

Compared to the temperature of the cooling plate 1 indicated by the fine solid line 1A, the temperature of the cooling plate 1*a* indicated by the bold solid line 1B is higher overall and the temperature of the cooling plate 1*b* also indicated by the bold solid line 1B is lower overall.

The reason for the lower temperature of the cooling plate 1*b* is that the interval provided between the cooling plates 1*a* and 1*b* prevents thermal transmission between the cooling plates 1*a* and 1*b*. Assuming that the cooling plates 1*a* and 1*b* are that contacts with each other without an interval therebetween, thermal transmission between the cooling plates 1*a* and 1*b* occurs. Consequently, temperature distribution is equalized between the cooling plates 1*a* and 1*b*, resulting in the similar temperature distribution obtained in the case of the second comparative example in which the single cooling plate 1 is provided as illustrated in FIG. 6(*a*).

As described above, in order to reduce the temperature of the sheet P discharged to the discharge storage 17, it is more effective that a portion which cools the sheet P at the last stage of cooling operation has a lower temperature. The two separate cooling plates 1*a* and 1*b* according to the first illustrative embodiment, which are arranged side by side at an interval therebetween in the direction of conveyance of the sheet P, can prevent thermal transmission from the upstream cooling plate 1*a* to the downstream cooling plate 1*b* and the temperature increase at the downstream end of the cooling plate 1*b*. Accordingly, the cooling plates 1*a* and 1*b* can more effectively cool the sheet P compared to the case in which the sheet P is cooled by the single cooling plate 1. As a result, a temperature increase in the liquid coolant flowing through the downstream end of the cooling plate 1*b* can also be prevented, thereby efficiently and effectively cooling the sheet P even at the downstream end of the cooling plate 1*b*.

Figure 7:
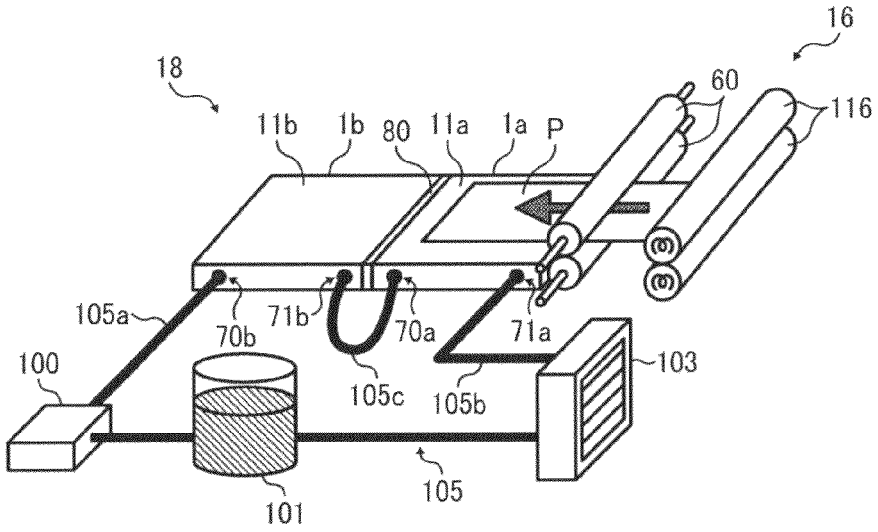
FIG. 7 is schematic view illustrating an example of an overall configuration of the cooling device including a thermal insulator between the cooling plates.

Alternatively, in a variation illustrated in FIG. 7, a thermal insulator 80 may be provided between the cooling plates 1*a* and 1*b* to prevent thermal transmission between the cooling plates 1*a* and 1*b*. In such a case, the same effects as those obtained by the first illustrative embodiment described above can be achieved.

Figure 8:
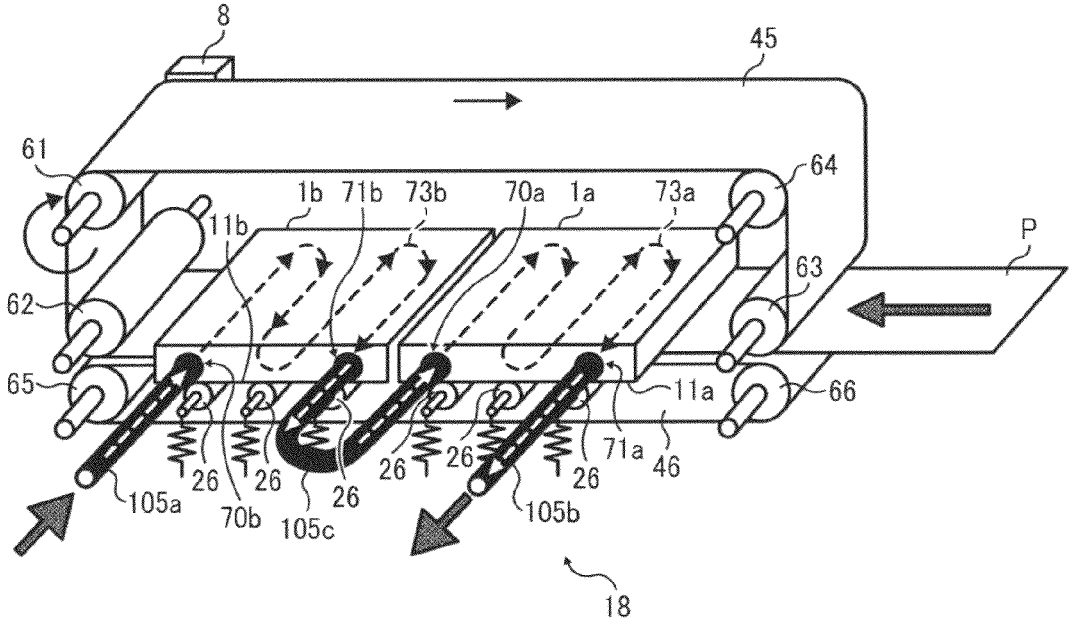
FIG. 8 is a perspective view illustrating an example of a configuration around cooling plates included in a cooling device according to a second illustrative embodiment.

A description is now given of a second illustrative embodiment of the present invention. FIG. 8 is a perspective view illustrating an example of a configuration around the cooling plates 1*a* and 1*b* provided to the cooling device 18 according to the second illustrative embodiment.

In the second illustrative embodiment, a polyimide cooling belt 45 is rotatably wound around a drive roller 61 and multiple driven rollers 62, 63, and 64. In addition, a conveyance belt 46 would around driven rollers 65 and 66 is provided opposite the cooling belt 45. The conveyance belt 46 is formed of an elastic material such as acrylic rubber or polyimide, or has a multi-layered structure formed of the elastic material and polyimide. The sheet P is conveyed, while sandwiched between the cooling belt 45 and the conveyance belt 46, by the cooling belt 45 rotated by a drive force from the drive roller 61 and the conveyance belt 46 rotated as the cooling belt 45 rotates.

The two separate cooling plates 1*a* and 1*b* arranged side by side at an interval therebetween in the direction of conveyance of the sheet P and connected with each other by the tube 105*c* are fixed to contact an inner circumference of the cooling belt 45. The cooling plates 1*a* and 1*b* contact the inner circumference of the cooling belt 45 rotated by the drive roller 61 to absorb heat, via the cooling belt 45, from the sheet P conveyed by the cooling belt 45 and the conveyance belt 46.

The inlet 70*b* from which the liquid coolant enters the cooling plate 1*b* is provided at the downstream end on the lateral surface of the cooling plate 1*b*. The outlet 71*b* from which the liquid coolant is discharged from the cooling plate 1*b* is provided at the upstream end on the lateral surface of the cooling plate 1*b*. The inlet 70*b* and outlet 71*b* of the cooling plate 1*b* are connected to the respective ends of the serpentine internal channel 73*b* formed within the cooling plate 1*b* in the width direction of the sheet P. One end of the tube 105*a* is connected to the pump 100, and the other end thereof is connected to the inlet 70*b*. One end of the tube 105*c* is connected to the outlet 71*b*.

The inlet 70*a* from which the liquid coolant enters the cooling plate 1*a* is provided at the downstream end on the lateral surface of the cooling plate 1*a*. The outlet 71*a* from which the liquid coolant is discharged from the cooling plate 1*a* is provided at the upstream end on the lateral surface of the cooling plate 1*a*. The inlet 70*a* and outlet 71*a* of the cooling plate 1*a* are connected to the respective ends of the serpentine internal channel 73*a* formed within the cooling plate 1*a* in the width direction of the sheet P. One end of the tube 105*c* is connected to the outlet 71*b* of the cooling plate 1*b*, and the other end thereof is connected to the inlet 70*a* of the cooling plate 1*a*. One end of the tube 105*b* is connected to the radiator 103, and the other end thereof is connected to the outlet 71*a* of the cooling plate 1*a*.

The liquid coolant enters the cooling plate 1*b* via the tube 105*a* and is discharged from the cooling plate 1*b* to the tube 105*c*. Then, the liquid coolant thus discharged from the cooling plate 1*b* enters the cooling plate 1*a* via the tube 105*c* and is discharged from the cooling plate 1*a* to the tube 105*b*.

Multiple pressing rollers 26, each contacting an inner circumference of the conveyance belt 46 to press the conveyance belt 46 against the cooling plates 1*a* and 1*b*, are provided inside the loop of the conveyance belt 46. Accordingly, an outer circumference of the cooling belt 45 more reliably contacts the sheet P and the cooling plates 1*a* and 1*b* more reliably contact the inner circumference of the cooling belt 45. Further, the cooling belt 45 and the conveyance belt 46 more securely convey the sheet P.

The sheet P sandwiched and conveyed by the cooling belt 45 and the conveyance belt 46 is cooled by the cooling plates 1*a* and 1*b* via a thermal transmission member, which, in the present illustrative embodiment, is the cooling belt 45. As a result, the sheet P does not slide against the cooling plates 1*a* and 1*b*, thereby preventing blots or blurs on the sheet P caused by sliding against the cooling plates 1*a* and 1*b*.

In a manner similar to the first illustrative embodiment, in the second illustrative embodiment the liquid coolant flows through the two separate cooling plates 1*b* and 1*a* from downstream to upstream, that is, the liquid coolant flows from the cooling plate 1*b* to the cooling plate 1*a*, so as to cool the sheet P by the cooling plates 1*a* and 1*b* using the liquid coolant. As a result, the downstream end of the cooling plate 1*b* which cools the sheet P in the last stage of cooling operation has a lower temperature, thereby efficiently cooling the sheet P. In addition, as described previously in the first illustrative embodiment, use of the two separate cooling plates 1*a* and 1*b* arranged side by side at an interval therebetween can more effectively cool the sheet P compared to the case in which the single cooling plate 1 is used.

Figure 9:
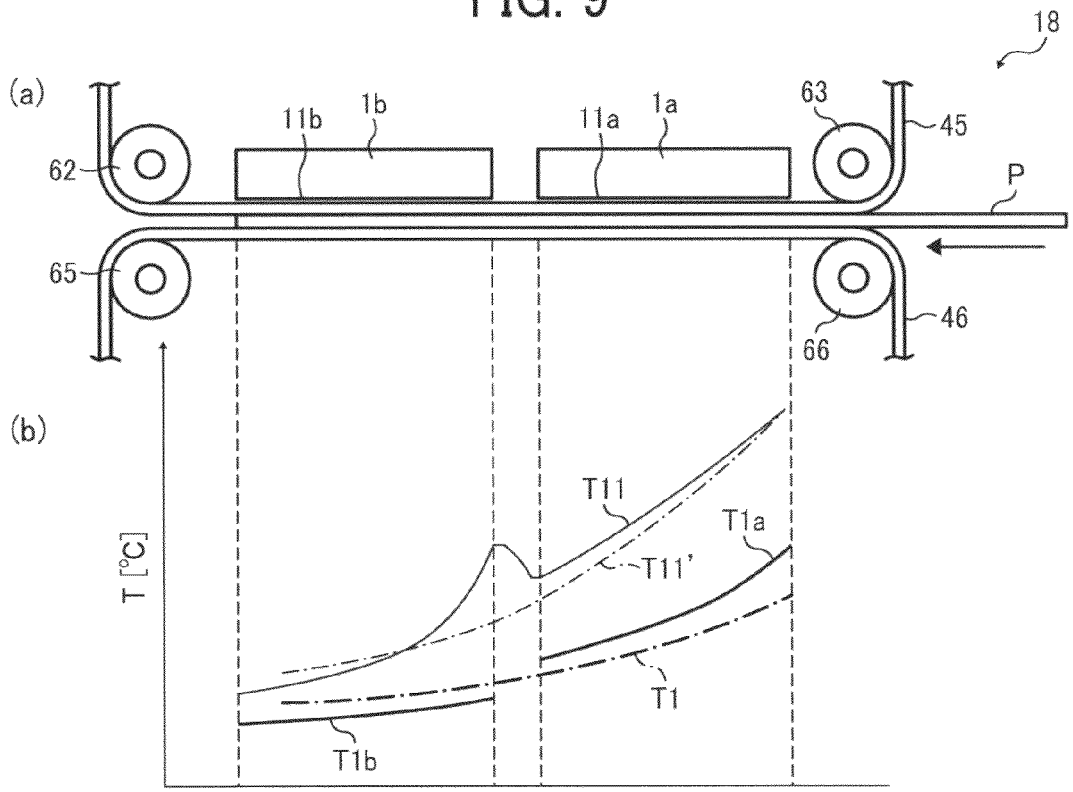
FIG. 9(*a*) is a side view illustrating the configuration around the cooling plates in the cooling device according to the second illustrative embodiment.

FIG. 9(*a*) is a side view illustrating the configuration around the cooling plates 1*a* and 1*b* in the cooling device 18 according to the second illustrative embodiment, and FIG. 9(*b*) is a graph showing temperature distribution corresponding to the configuration illustrated in FIG. 9(*a*).

While the sheet P having a higher temperature heated by the fixing device 16 is conveyed by the cooling belt 45 and the conveyance belt 46, the heat-absorbing surfaces 11*a* and 11*b* of the cooling plates 1*a* and 1*b* slidably contact the inner circumference of the cooling belt 45 and absorb heat from the sheet P via the cooling belt 45.

At this time, temperature distribution occurs in both the cooling plates 1*a* and 1*b*. A fine solid line T11 in FIG. 9(*b*) indicates temperature distribution in a target surface of the sheet P to be cooled, that is, an upper surface of the sheet P. A bold solid line T1*a* indicates temperature distribution in the heat-absorbing surface 11*a* (the lower surface) of the cooling plate 1*a*, and the bold solid line T1*b* indicates temperature distribution in the heat-absorbing surface 11*b* (the lower surface) of the cooling plate 1*b*.

A fine broken line T11' indicates temperature distribution in the target surface of the sheet P in a case of a comparative example in which the cooling plates 1*a* and 1*b* are arranged side by side to contact each other without an interval therebetween. A bold broken line T1 indicates temperature distribution in the heat-absorbing surfaces (the lower surfaces) 11*a* and 11*b* of the cooling plates 1*a* and 1*b* in the case of the comparative example.

As described previously in the first illustrative embodiment, thermal transmission between the cooling plates 1*a* and 1*b* does not occur when the cooling plates 1*a* and 1*b* are disposed in upstream and downstream sides within the cooling device 18 in the direction of conveyance of the sheet P, respectively, with an interval therebetween. Therefore, compared to the case of the comparative example, the upstream cooling plate 1*a* has a higher temperature and the downstream cooling plate 1*b* has a lower temperature in the second illustrative embodiment.

The temperature of the downstream end of the cooling plate 1*b* considerably affects the temperature of the sheet P discharged from the cooling device 18. Therefore, the cooling plate 1*b* having a lower temperature can more effectively cool the sheet P even if the temperature of the cooling plate 1*a* is somewhat higher.

After the sheet P passes the cooling plate 1*a*, the temperature of the sheet P is increased by heat retained by the sheet P while the sheet P passes through the interval between the cooling plates 1*a* and 1*b* because the sheet P is not cooled in that interval. The higher the temperature of the sheet P, the cooling members such as the cooling plates 1*a* and 1*b* more easily absorb heat from the sheet P. Therefore, the temperature increase in the sheet P at the interval between the cooling plates 1*a* and 1*b* is advantageous for the cooling device 18 to cool the sheet P.

Thus, the sheet P is more effectively cooled by the cooling plates 1*a* and 1*b* disposed at an interval therebetween compared to the case in which the cooling plates 1*a* and 1*b* are disposed to contact with each other without an interval therebetween.

It is preferable that the heat-absorbing surfaces 11*a* and 11*b* of the cooling plates 1*a* and 1*b* be disposed on the same level with a difference in height of not greater than 100 μm.

Figure 10:
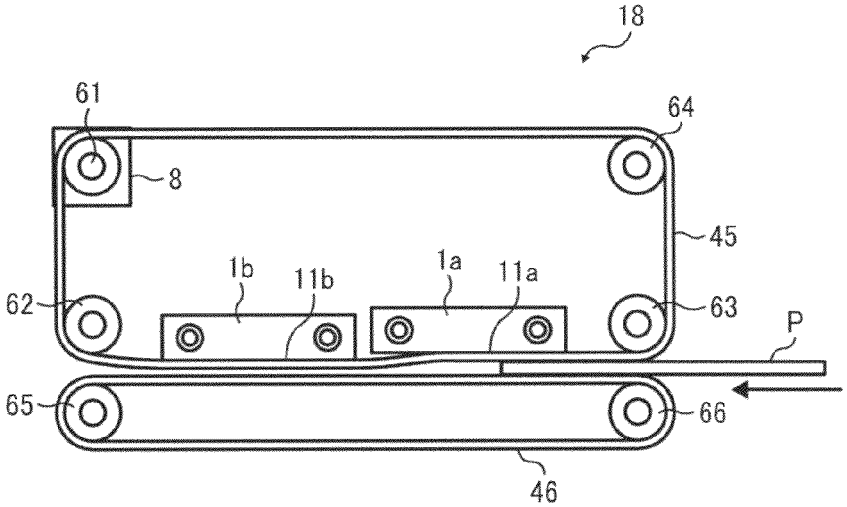
FIG. 10 is a vertical cross-sectional view illustrating an example of a configuration of the cooling device according to the second illustrative embodiment in a case in which the cooling plates are not appropriately disposed.

FIG. 10 is a vertical cross-sectional view illustrating an example of a configuration of the cooling device 18 according to the second illustrative embodiment in a case in which the cooling plates 1*a* and 1*b* are not appropriately disposed but instead are vertically offset from each other. When the heat-absorbing surfaces 11*a* and 11*b* of the cooling plates 1*a* and 1*b* are disposed with a difference in height and do not together form a single flush surface as illustrated in FIG. 10, a gap is generated between the cooling belt 45 and the cooling plate 1*a* or 1*b*. In the example illustrated in FIG. 10, there is a gap between the cooling belt 45 and the downstream portion of the cooling plate 1*a*. Consequently, the sheet P cannot be cooled by the cooling plate 1*a* at that portion where the gap exists. In addition, a step between the cooling plates 1*a* and 1*b* causes large loads on the cooling belt 45, resulting in rapid deterioration of the cooling belt 45.

Figure 11A:
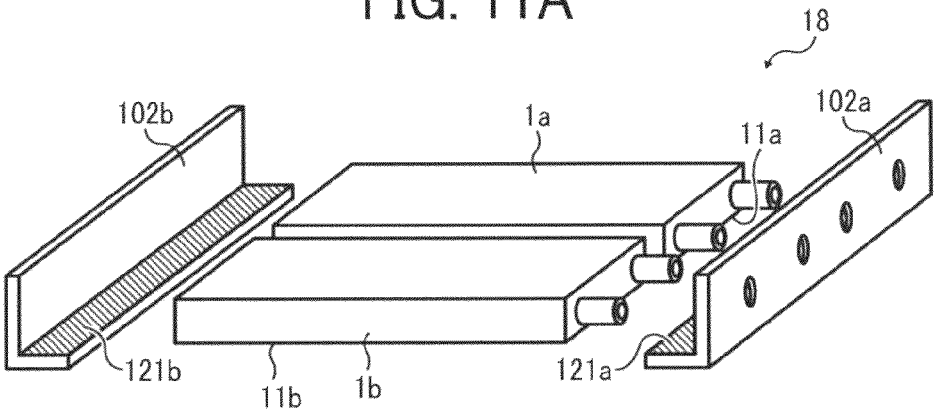
FIGS. 11A and 11B are perspective views respectively illustrating positioning members provided to the cooling device according to the second illustrative embodiment.
Figure 11B:
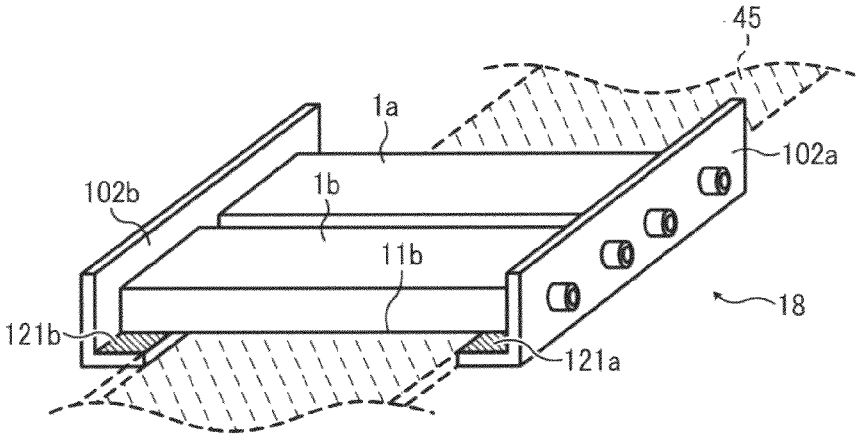

FIGS. 11A and 11B are perspective views illustrating an example of a configuration of positioning members 102*a* and 102*b* provided to the cooling device 18. Specifically, FIG. 11A is a perspective view illustrating a state in which the cooling plates 1*a* and 1*b* are not yet placed on the positioning members 102*a* and 102*b*, and FIG. 11B is a perspective view illustrating a state in which the cooling plates 1*a* and 1*b* are placed on the positioning members 102*a* and 102*b*.

Both the heat-absorbing surfaces 11*a* and 11*b* of the cooling plates 1*a* and 1*b* are placed on the same surface of each of the positioning members 102*a* and 102*b* so as to dispose the heat-absorbing surfaces 11*a* and 11*b* at substantially the same height.

Each of the positioning members 102*a* and 102*b* has an L-shape in cross-section and includes a positioning surface 121*a* or 121*b* on which the cooling plates 1*a* and 1*b* are placed. As illustrated in FIG. 11B, both the positioning surfaces 121*a* and 121*b* are positioned outside the both edges of the cooling belt 45 in a width direction of the cooling belt 45.

Figure 12:
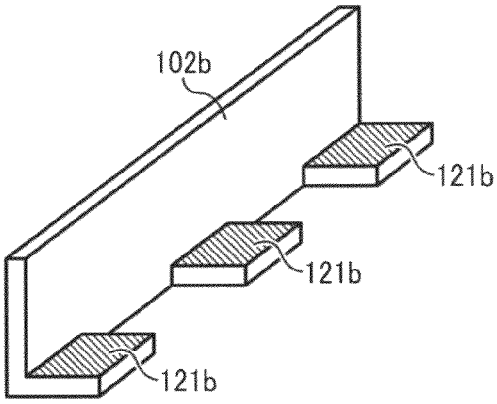
FIG. 12 is a perspective view illustrating an example of a configuration of a positioning member having cutouts.

Alternatively, although only the positioning member 102*b* is shown as a representative example in FIG. 12, each of the positioning surfaces 121*a* and 121*b* of the positioning member 102*a* and 102*b* may have cutouts, as long as a desired flatness is obtained at a contact surface in which the positioning surface 121*a* or 121*b* contacts the cooling plates 1*a* and 1*b*. As a result, the heat-absorbing surfaces 11*a* and 11*b* of the cooling plates 1*a* and 1*b* are disposed on the same level with a difference in height of not greater than 100 μm.

As described above, in the second illustrative embodiment, the sheet P is sandwiched and conveyed by the cooling belt 45 and the conveyance belt 46, each of which is wound around the multiple rollers. The cooling plates 1*a* and 1*b* are arranged side by side at an interval therebetween in the direction of conveyance of the sheet P to slidably contact the inner circumference of the cooling belt 45. Alternatively, the cooling plates 1*a* and 1*b* may be disposed to contact the inner circumferences of the cooling belt 45 and the conveyance belt 46, respectively. Such a configuration is described in detail later in a third illustrative embodiment.

Figure 13:
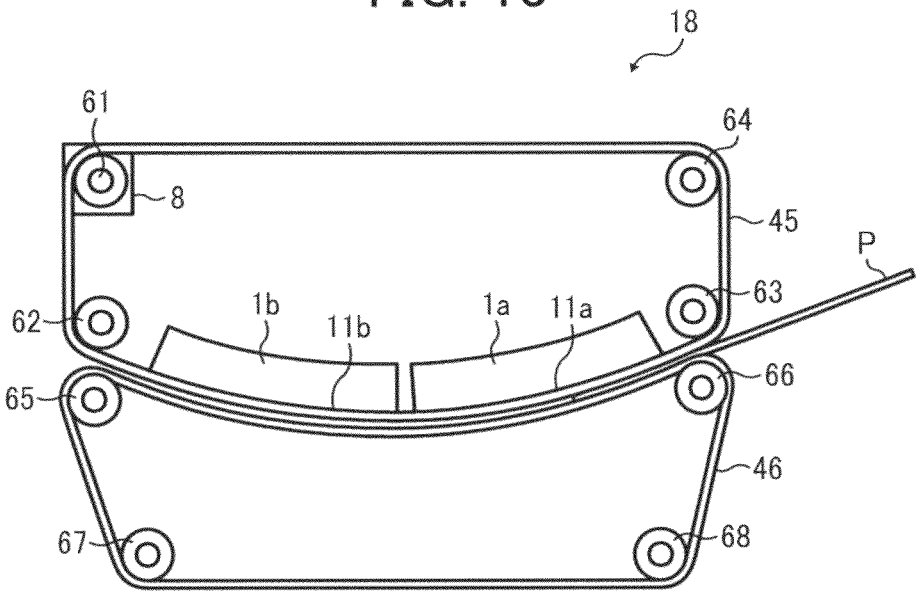
FIG. 13 is a vertical cross-sectional view illustrating an example of a configuration of a cooling device according to a first variation of the second illustrative embodiment.

A description is now given of a first variation of the second illustrative embodiment. FIG. 13 is a vertical cross-sectional view illustrating an example of a configuration of the cooling device 18 according to the first variation of the second illustrative embodiment.

As illustrated in FIG. 13, each of the heat-absorbing surfaces 11*a* and 11*b* of the cooling plates 1*a* and 1*b* are convexly curved. Accordingly, the heat-absorbing surfaces 11*a* and 11*b* more evenly contact the inner circumference of the cooling belt 45.

The cooling plates 1*a* and 1*b* have the same shape, and each of the heat-absorbing surfaces 11*a* and 11*b* has an even curvature radius. Thus, the heat-absorbing surfaces 11*a* and 11*b* can more easily be disposed to together form a single flat stepless plane, and such a configuration can be easily achieved even when number of cooling members is increased to three, four, and so on.

In addition to the driven rollers 65 and 66, driven rollers 67 and 68 are provided so that the conveyance belt 46 is wound around the four rollers 65, 66, 67, and 68. Thus, both the cooling belt 45 and the conveyance belt 46 more evenly contact the sheet P. As a result, the cooling device 18 can be more effectively cool the sheet P.

Figure 14:
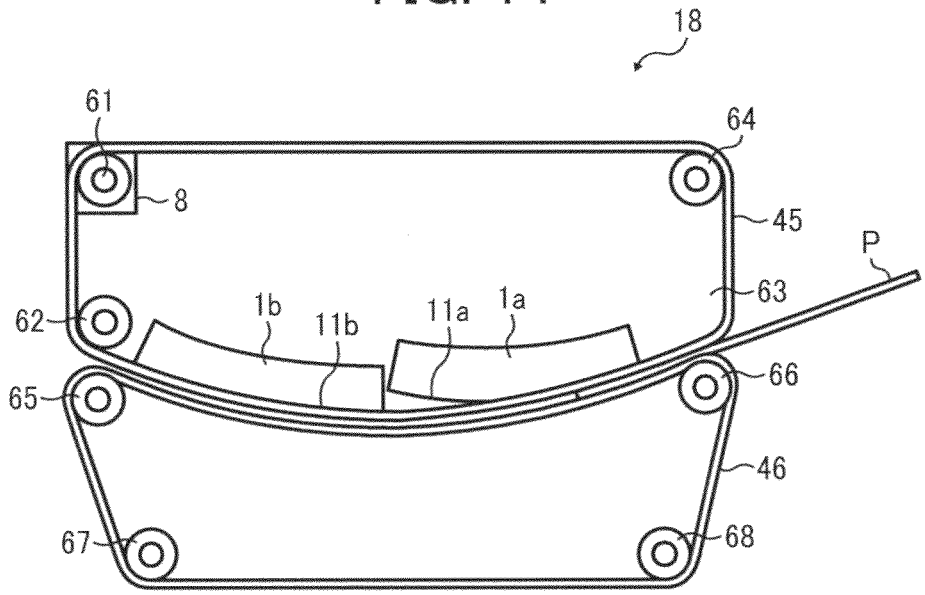
FIG. 14 is a vertical cross-sectional view illustrating an example of a configuration of the cooling device illustrated in FIG. 13 in which the cooling plates are not appropriately disposed.

The following problems occur when the cooling plates 1*a* and 1*b* are not optimally arranged inside the loop of the cooling belt 45 and the heat-absorbing surfaces 11*a* and 11*b* of the cooling plates 1*a* and 1*b* do not together form a single flat plane. In a manner similar to the example illustrated in FIG. 10, a gap is generated between the cooling belt 45 and the cooling plate 1*a* or 1*b* around the interval between the cooling plates 1*a* and 1*b*. In the example illustrated in FIG. 14, there is a gap between the cooling belt 45 and the downstream portion of the cooling plate 1*a*. Because the cooling plate 1*a* does not contact the cooling belt 45 at the downstream portion where the gap exists, the sheet P cannot be cooled at that portion. In addition, a step between the cooling plates 1*a* and 1*b* causes large loads on the cooling belt 45, resulting in rapid deterioration of the cooling belt 45.

Figure 15:
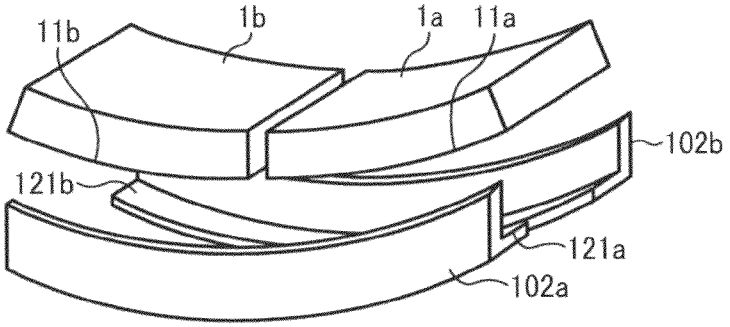
FIG. 15 is a perspective view illustrating an example of a configuration of the cooling plates and the positioning members included in the cooling device according to the first variation of the second illustrative embodiment.

To solve the above problems, the cooling device 18 according to the first variation of the second illustrative embodiment includes the positioning members 102*a* and 102*b* as illustrated in FIG. 15. The positioning members 102*a* and 102*b* have the positioning surfaces 121*a* and 121*b*, respectively, each of which has the same curvature as the heat-absorbing surfaces 11*a* and 11*b* of the cooling plates 1*a* and 1*b*. The cooling plates 1*a* and 1*b* are placed on the positioning surfaces 121*a* and 121*b* of the positioning members 102*a* and 102*b*. As a result, the cooling plates 1*a* and 1*b* are appropriately disposed such that the heat-absorbing surfaces 11*a* and 11*b* together form a single curved stepless plane.

Figure 16:
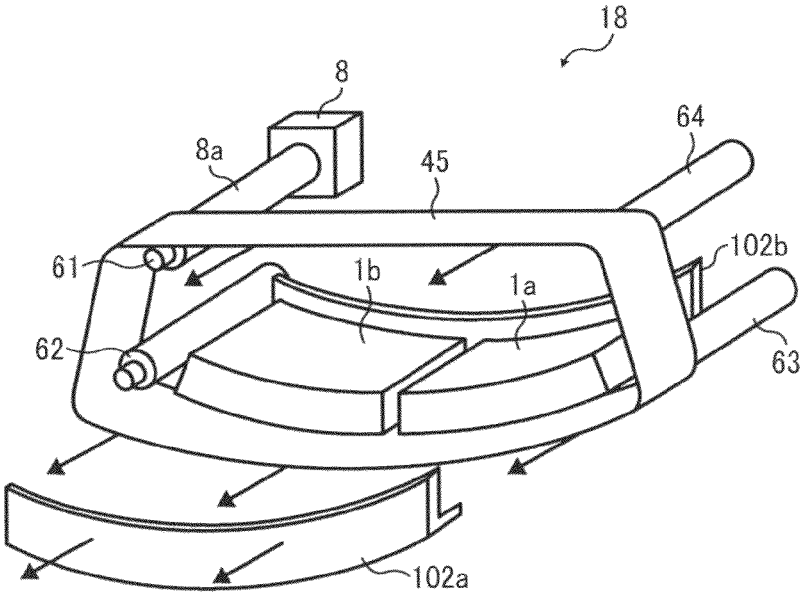
FIG. 16 is a perspective view illustrating replacement of a cooling belt included in the cooling device according to the first variation of the second illustrative embodiment.

Alternatively, each of the curved positioning surfaces 121*a* and 121*b* may have cutouts in a manner similar to the example illustrated in FIG. 12 as long as a desired outline is obtained at a contact surface in which the positioning surface 121*a* or 121*b* contacts the heat-absorbing surfaces 11*a* and 11*b* of the cooling plates 1*a* and 1*b*. Further alternatively, the positioning member 102*a* may be detachably installed in the cooling device 18 as illustrated in FIG. 16 such that the positioning member 102*a* is detached from the cooling device 18 upon replacement of the cooling belt 45, thereby facilitating attachment and detachment of the cooling belt 45 to and from the cooling device 18. In the example illustrated in FIG. 16, each of the positioning member 102*a* and the cooling belt 45 is detached from the cooling device 18 in a direction indicated by arrows, that is, a direction opposite a drive motor 8 in an axial direction of a drive roller 8*a*.

Figure 17:
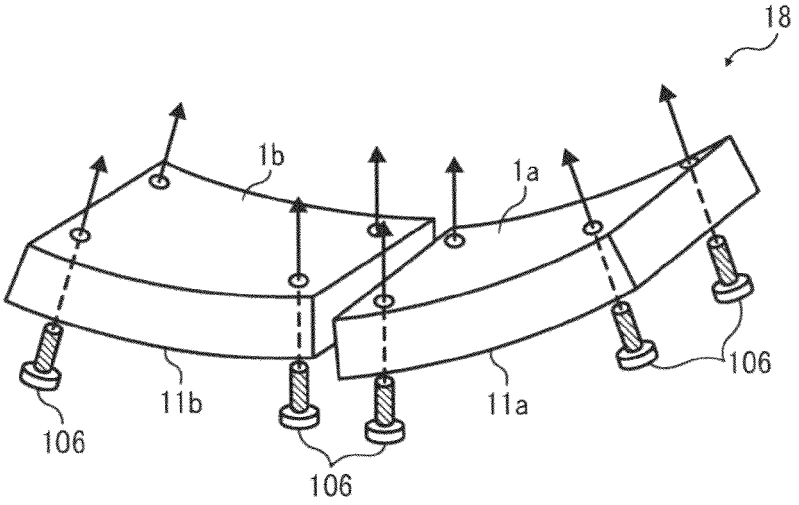
FIG. 17 is a perspective view illustrating an example of a configuration of a cooling device according to a second variation of the second illustrative embodiment.

A description is now given of a second variation of the second illustrative embodiment with reference to FIG. 17. FIG. 17 is a schematic view illustrating how to fix the cooling plates 1*a* and 1*b* to the cooling device 18.

As described previously, when the cooling plates 1*a* and 1*b* are not appropriately positioned inside the loop of the cooling belt 45, there may be a gap between the cooling belt 45 and the cooling plate 1*a* or 1*b*. Consequently, the sheet P cannot be effectively cooled by the cooling plate 1*a* or 1*b* and the cooling belt 45 may be damaged.

To solve the above problems, in the second variation of the second illustrative embodiment, the cooling plates 1*a* and 1*b* are fixed to the cooling device 18 without the positioning members 102*a* and 102*b*.

Specifically, each of the cooling plates 1*a* and 1*b* has a fastening point at each corner thereof into which an adjustment member, that is, a fastening screw 106, is inserted to fix the cooling plates 1*a* and 1*b* to the cooling device 18. The adjustment member can adjust a position and an angle of each of the cooling plates 1*a* and 1*b*. A fastening depth of each of the screws 106 is adjusted at each fastening point such that a height and an angle of each of the cooling plates 1*a* and 1*b* relative to the cooling device 18 can be finely adjusted. As a result, the heat-absorbing surfaces 11*a* and 11*b* of the cooling plates 1*a* and 1*b* together form a single curved stepless plane.

Figure 18:
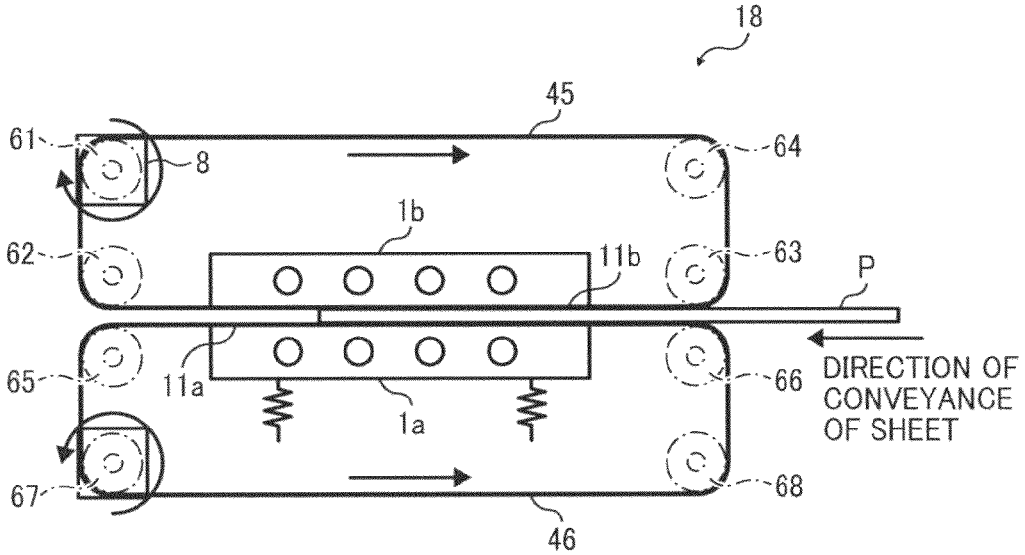
FIG. 18 is a vertical cross-sectional view illustrating an example of a configuration of a cooling device according to a third illustrative embodiment.

A description is now given of a third illustrative embodiment of the present invention with reference to FIG. 18. FIG. 18 is a vertical cross-sectional view illustrating an example of a configuration of the cooling device 18 according to the third illustrative embodiment. In the third illustrative embodiment, the cooling plates 1*a* and 1*b* are disposed vertically one above the other.

As illustrated in FIG. 18, the cooling belt 45 is rotatably wound around the drive roller 61 and the multiple driven rollers 62, 63, and 64. In addition, the conveyance belt 46 is rotatably wound around the drive roller 67 and the multiple driven rollers 65, 66, and 68. The cooling plate 1*a* is provided opposite the cooling plate 1*b* with both the cooling belt 45 and the conveyance belt 46 interposed therebetween so that both upper and lower surfaces of the sheet P can be cooled by the cooling plates 1*b* and 1*a*, respectively, at the same time.

As a result, the sheet P heated by the fixing device 16 can be more efficiently cooled by the cooling plates 1*a* and 1*b* from both the upper and lower surfaces of the sheet P, thereby achieving good cooling efficiency in a shorter cooling path.

Figure 19:
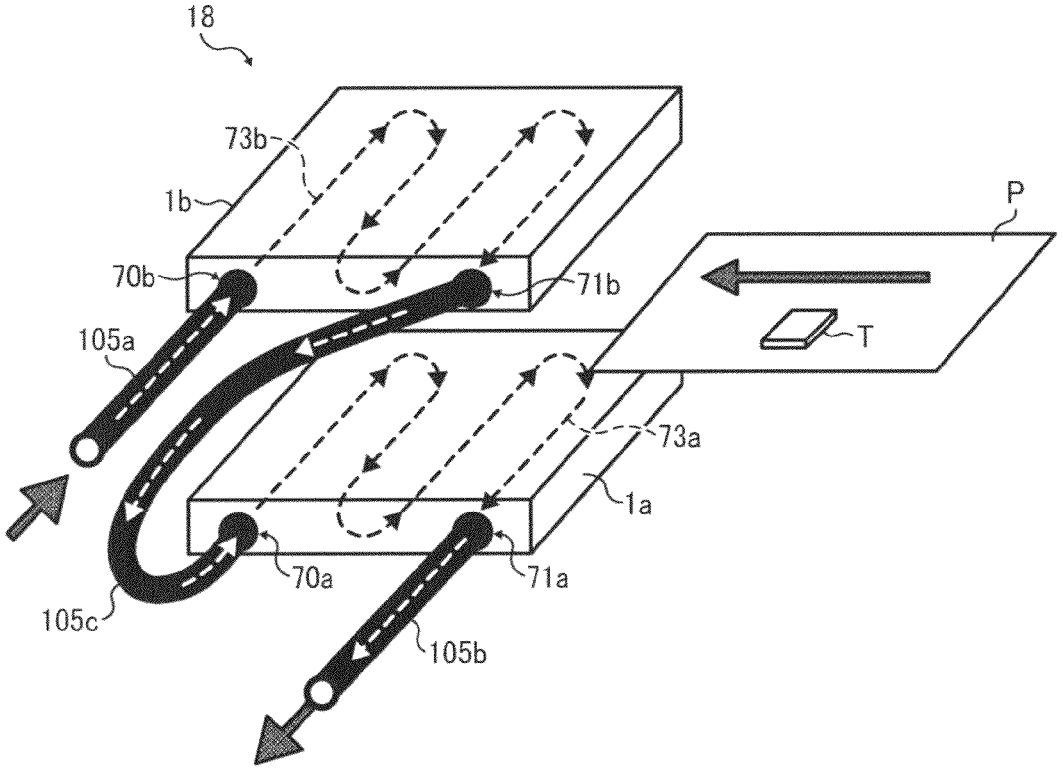
FIG. 19 is a schematic view illustrating a flow of liquid coolant in the cooling device illustrated in FIG. 18.

FIG. 19 is a schematic view illustrating an example of a flow of the liquid coolant in the cooling plates 1*a* and 1*b* provided to the cooling device 18 illustrated in FIG. 18.

The inlet 70*b* from which the liquid coolant enters the cooling plate 1*b* is provided at the downstream end on the lateral surface of the cooling plate 1*b* provided above the cooling plate 1*a*. The outlet 71*b* from which the liquid coolant is discharged from the cooling plate 1*b* is provided at the upstream end on the lateral surface of the cooling plate 1*b*. The inlet 70*b* and outlet 71*b* of the cooling plate 1*b* are connected to the respective ends of the serpentine internal channel 73*b* formed within the cooling plate 1*b* in the width direction of the sheet P. One end of the tube 105*a* is connected to the pump 100, and the other end thereof is connected to the inlet 70*b*. One end of the tube 105*c* is connected to the outlet 71*b*.

The inlet 70*a* from which the liquid coolant enters the cooling plate 1*a* is provided at the downstream end on the lateral surface of the cooling plate 1*a* provided below the cooling plate 1*b*. The outlet 71*a* from which the liquid coolant is discharged from the cooling plate 1*a* is provided at the upstream end on the lateral surface of the cooling plate 1*a*. The inlet 70*a* and outlet 71*a* of the cooling plate 1*a* are connected to the respective ends of the serpentine internal channel 73*a* formed within the cooling plate 1*a* in the width direction of the sheet P. One end of the tube 105*c* is connected to the outlet 71*b* of the cooling plate 1*b*, and the other end thereof is connected to the inlet 70*a* of the cooling plate 1*a*. One end of the tube 105*b* is connected to the radiator 103, and the other end thereof is connected to the outlet 71*a* of the cooling plate 1*a*.

The liquid coolant enters the cooling plate 1*b* from the inlet 70*b* provided at the downstream end of the cooling plate 1*b*, flows through the cooling plate 1*b* through the internal channel 73*b*, and is then discharged from the cooling plate 1*b* via the outlet 71*b* provided at the upstream end of the cooling plate 1*b* to the tube 105*c*. The liquid coolant thus discharged to the tube 105*c* then enters the cooling plate 1*a*, which is provided below the cooling plate 1*b*, from the inlet 70*a* provided at the downstream end of the cooling plate 1*a* and connected to the tube 105*c*, flows through the cooling plate 1*a* through the internal channel 73*a*, and is discharged from the cooling plate 1*a* via the outlet 71*a* provided at the upstream end of the cooling plate 1*a* to the tube 105*b*. Thus, the liquid coolant sequentially flows through the cooling plates 1*b* and 1*a*.

As illustrated in FIG. 19, when an image is formed only on an upper surface of the sheet P, a toner image T is fixed to the upper surface of the sheet P by the pair of fixing rollers 116. Therefore, the liquid coolant having a lower temperature first flows through the cooling plate 1*b* which faces the upper surface of the sheet P having the fixed toner image T thereon. As a result, the temperature of the cooling plate 1*b* can be kept lower, thereby more efficiently cooling the toner image T formed on the upper surface of the sheet P.

In addition, because the sheet P is cooled by the cooling plates 1*a* and 1*b* from both the upper and lower surfaces thereof, an amount of heat absorbed from the sheet P by each of the cooling plates 1*a* and 1*b* at the upstream portions thereof is reduced compared to the case in which both the cooling plates 1*a* and 1*b* are disposed side by side on the single side of the sheet P, that is, either above or below the conveyance path of the sheet P. As a result, an amount of heat transmitted from upstream to downstream in each of the cooling plates 1*a* and 1*b* is also reduced, thereby preventing a temperature increase in the downstream end of each of the cooling plates 1*a* and 1*b*. Accordingly, a temperature increase in the liquid coolant flowing at the downstream end of each of the cooling plates 1*a* and 1*b*, which cools the sheet P in the last stage of cooling operation, can be prevented, thereby efficiently cooling the sheet P even at the downstream end of each of the cooling plates 1*a* and 1*b*.

Figure 20:
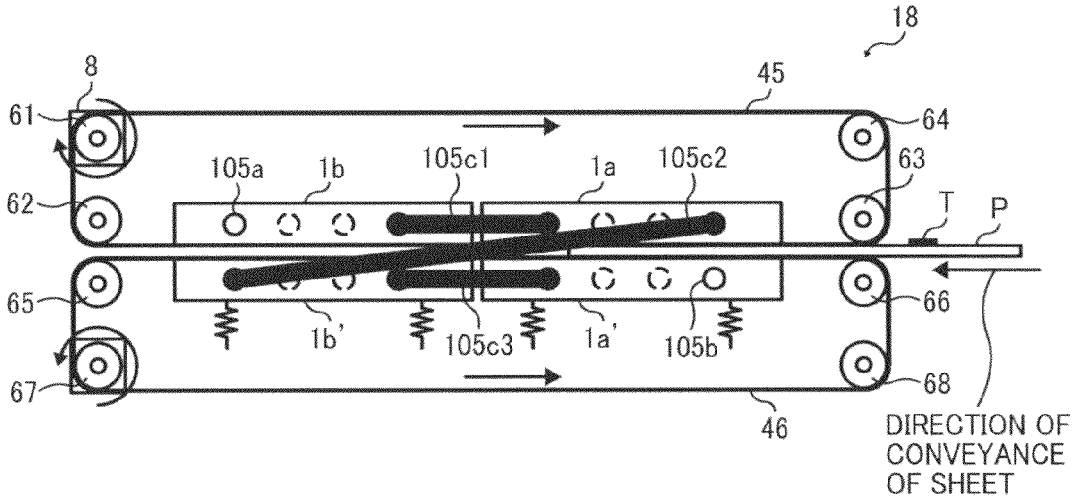
FIG. 20 is a vertical cross-sectional view illustrating an example of a configuration of a cooling device according to a first variation of the third illustrative embodiment.

A description is now given of a first variation of the third illustrative embodiment. FIG. 20 is a schematic view illustrating an example of a configuration of the cooling device 18 according to the first variation of the third illustrative embodiment. In the cooling device 18 illustrated in FIG. 20, the two separate cooling plates 1*a* and 1*b* arranged side by side at an interval therebetween in the direction of conveyance of the sheet P and connected with each other by a tube 105*c*1 are fixed to contact the inner circumference of the cooling belt 45. In addition, a second pair of cooling plates 1*a*' and 1*b*' arranged side by side at an interval therebetween in the direction of conveyance of the sheet P and connected with each other by a tube 105*c*3 are fixed to contact an inner circumference of the conveyance belt 46.

The liquid coolant first flows through the cooling plates 1*b* and 1*a* provided above the second pair of cooling plates 1*b*' and 1*a*', and then flows through the cooling plates 1*b*' and 1*a*'.

Figure 21:
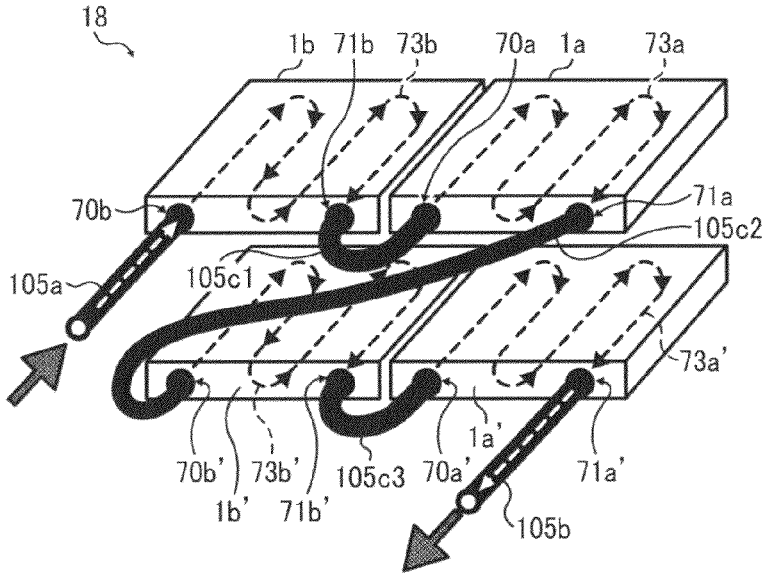
FIG. 21 is a schematic view illustrating an example of a configuration around cooling plates included in the cooling device illustrated in FIG. 20.

Specifically, as illustrated in FIG. 21, the liquid coolant enters the cooling plate 1*b* from the inlet 70*b* provided at the downstream end on the lateral surface of the cooling plate 1*b*, flows through the cooling plate 1*b* through the internal channel 73*b*, and then is discharged to the tube 105*c*1 from the cooling plate 1*b* via the outlet 71*b* provided at the upstream end on the lateral surface of the cooling plate 1*b*. Next, the liquid coolant discharged to the tube 105*c*1 enters the cooling plate 1*a* from the inlet 70*a* provided at the downstream end on the lateral surface of the cooling plate 1*a*, flows through the cooling plate 1*a* through the internal channel 73*a*, and is then discharged to a tube 105*c*2 from the cooling plate 1*a* via the outlet 71*a* provided at the upstream end on the lateral surface of the cooling plate 1*a*.

Subsequently, the liquid coolant discharged to the tube 105*c*2 enters the cooling plate 1*b*' from an inlet 70*b*' provided at a downstream end on a lateral surface of the cooling plate 1*b*', flows through the cooling plate 1*b*' through an internal channel 73*b*', and is then discharged to the tube 105*c*3 from the cooling plate 1*b*' via an outlet 71*b*' provided at an upstream end on the lateral surface of the cooling plate 1*b*'. Thereafter, the liquid coolant discharged to the tube 105*c*3 enters the cooling plate 1*a*' from an inlet 70*a*' provided at a downstream end on a lateral surface of the cooling plate 1*a*', flows through the cooling plate 1*a*' through an internal channel 73*a*', and is then discharged to the tube 105*b* from the cooling plate 1*a*' via an outlet 71*a*' provided at an upstream end on the lateral surface of the cooling plate 1*a*'.

Thus, the liquid coolant having a lower temperature first flows through the cooling plates 1*b* and 1*a*, each of which faces the upper surface of the sheet P having the fixed toner image T thereon. As a result, the cooling plates 1*a*, 1*b*, 1*a*' and 1*b*' can efficiently absorb heat from both the upper and lower surfaces the sheet P to effectively cool the sheet P. In addition, the temperature of each of the cooling plates 1*a* and 1*b* provided above the cooling plates 1*a*' and 1*b*' can be kept lower, thereby more efficiently cooling the toner image T formed on the upper surface of the sheet P.

Further, thermal transmission from the cooling plate 1*a* or 1*a*', each of which is provided upstream from the cooling plate 1*b* or 1*b*', to the cooling plate 1*b* or 1*b*' can be prevented. Accordingly, a temperature increase in the downstream end of the cooling plate 1*b* or 1*b*' can be prevented. As a result, a temperature increase in the liquid coolant flowing through the downstream end of each of the cooling plates 1*b* and 1*b*', which cools the sheet P in the last stage of cooling operation, can be prevented, thereby efficiently and effectively cooling the sheet P even at the downstream end of each of the cooling plates 1*b* and 1*b*'.

Figure 22:
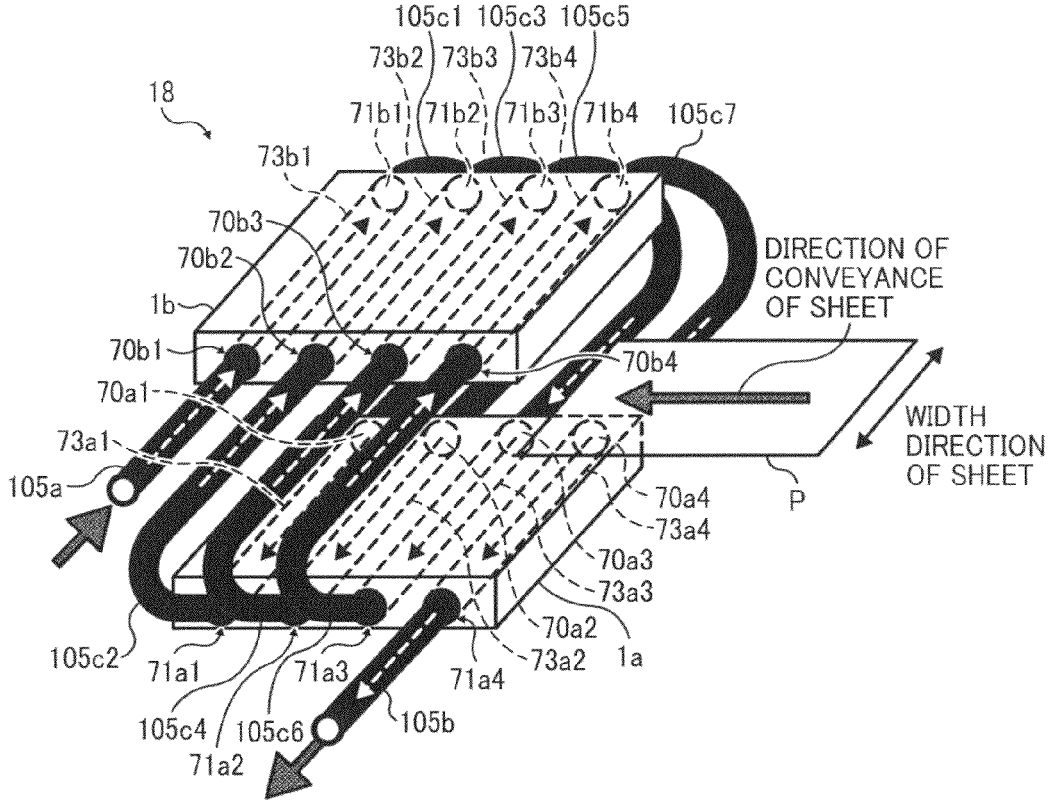
FIG. 22 is a schematic view illustrating an example of a configuration of a cooling device according to a second variation of the third illustrative embodiment.

A description is now given of a second variation of the third illustrative embodiment. FIG. 22 is a schematic view illustrating an example of a flow of the liquid coolant in the cooling device 18 according to the second variation of the third illustrative embodiment.

In the cooling plate 1*b* provided above the cooling plate 1*a*, multiple internal channels 73*b*1, 73*b*2, 73*b*3, and 73*b*4 are provided, in that order, from downstream to upstream in the direction of conveyance of the sheet P. Each of the internal channels 73*b*1, 73*b*2, 73*b*3, and 73*b*4 passes through the cooling plate 1*b* in the width direction of the sheet P perpendicular to the direction of conveyance of the sheet P. One end of each of the internal channels 73*b*1, 73*b*2, 73*b*3, and 73*b*4 is connected to inlets 70*b*1, 70*b*2, 70*b*3, and 70*b*4, respectively, and the other end of each of the internal channels 73*b*1, 73*b*2, 73*b*3, and 73*b*4 is connected to outlets 71*b*1, 71*b*2, 71*b*3, and 71*b*4, respectively.

In a manner similar to the cooling plate 1*b*, in the cooling plate 1*a* provided below the cooling plate 1*b*, multiple internal channels 73*a*1, 73*a*2, 73*a*3, and 73*a*4 are provided, in that order, from downstream to upstream in the direction of conveyance of the sheet P, and each of the internal channels 73*a*1, 73*a*2, 73*a*3, and 73*a*4 passes through the cooling plate 1*a* in the width direction of the sheet P. One end of each of the internal channels 73*a*1, 73*a*2, 73*a*3, and 73*a*4 is connected to inlets 70*a*1, 70*a*2, 70*a*3, and 70*a*4, respectively, and the other end of each of the internal channels 73*a*1, 73*a*2, 73*a*3, and 73*a*4 is connected to outlets 71*a*1, 71*a*2, 71*a*3, and 71*a*4, respectively.

One end of the tube 105*a* is connected to the pump 100, and the other end thereof is connected to the inlet 70*b*1. The outlet 71*b*1 and the inlet 70*a*1 are connected to the respective ends of the tube 105*c*1, and the outlet 71*a*1 and the inlet 70*b*2 are connected to the respective ends of the tube 105*c*2. The outlet 71*b*2 and the inlet 70*a*2 are connected to the respective ends of the tube 105*c*3, and the outlet 71*a*2 and the inlet 70*b*3 are connected to the respective ends of a tube 105*c*4. The outlet 71*b*3 and the inlet 70*a*3 are connected to the respective ends of a tube 105*c*5, and the outlet 71*a*3 and the inlet 70*b*4 are connected to the respective ends of a tube 105*c*6. The outlet 71*b*4 and the inlet 70*a*4 are connected to the respective ends of a tube 105*c*7. One end of the tube 105*b* is connected to the radiator 103, and the other end thereof is connected to the outlet 71*a*4.

The liquid coolant enters the cooling plate 1*b* from the inlet 70*b*1 provided at the extreme downstream side on the lateral surface of the cooling plate 1*b*, alternately flows between the cooling plates 1*b* and 1*a* in a spiral manner, and is ultimately discharged from the cooling plate 1*a* via the outlet 71*a*4 provided at the extreme upstream side on the lateral surface of the cooling plate 1*a*.

As a result, the temperature of each of the cooling plates 1*a* and 1*b* is further reduced at the downstream end of each of the cooling plates 1*a* and 1*b*, and a difference in temperature between the cooling plates 1*a* and 1*b* can be reduced, thereby evenly cooling both the upper and lower surfaces of the sheet P.

In addition, because the sheet P is cooled by the cooling plates 1*a* and 1*b* from both the upper and lower surfaces thereof, an amount of heat absorbed from the sheet P by each of the cooling plates 1*a* and 1*b* at the upstream portions thereof is reduced compared to the case in which both the cooling plates 1*a* and 1*b* are disposed side by side on the single side of the sheet P, that is, either above or below the conveyance path of the sheet P. As a result, an amount of heat transmitted from upstream to downstream in each of the cooling plates 1*a* and 1*b* is also reduced, thereby preventing a temperature increase in the downstream end of each of the cooling plates 1*a* and 1*b*. Accordingly, a temperature increase in the liquid coolant flowing through the downstream end of each of the cooling plates 1*a* and 1*b*, which cools the sheet P in the last stage of cooling operation, can be prevented, thereby efficiently and effectively cooling the sheet P even at the downstream end of each of the cooling plates 1*a* and 1*b*.

Figure 23:
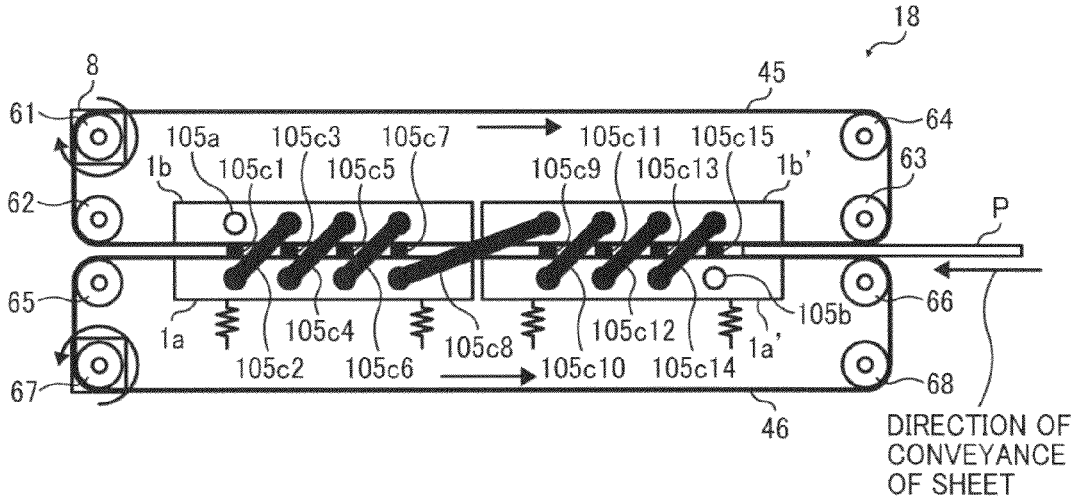
FIG. 23 is a vertical cross-sectional view illustrating an example of a configuration of a cooling device according to a third variation of the third illustrative embodiment.

A description is now given of a third variation of the third illustrative embodiment. FIG. 23 is a vertical cross-sectional view illustrating an example of a configuration of the cooling device 18 according to the third variation of the third illustrative embodiment.

In the cooling device 18 illustrated in FIG. 23, the two separate cooling plates 1*b* and 1*b*' arranged side by side at an interval therebetween in the direction of conveyance of the sheet P are fixed to contact the inner circumference of the cooling belt 45. The cooling plate 1*b* is provided downstream from the cooling plate 1*b*'. In addition, the two separate cooling plates 1*a* and 1*a*' arranged side by side at an interval therebetween in the direction of conveyance of the sheet P are fixed to contact the inner circumference of the conveyance belt 46 provided below the cooling belt 45. The cooling plate 1*a* is provided downstream from the cooling plate 1*a*'.

Figure 24:
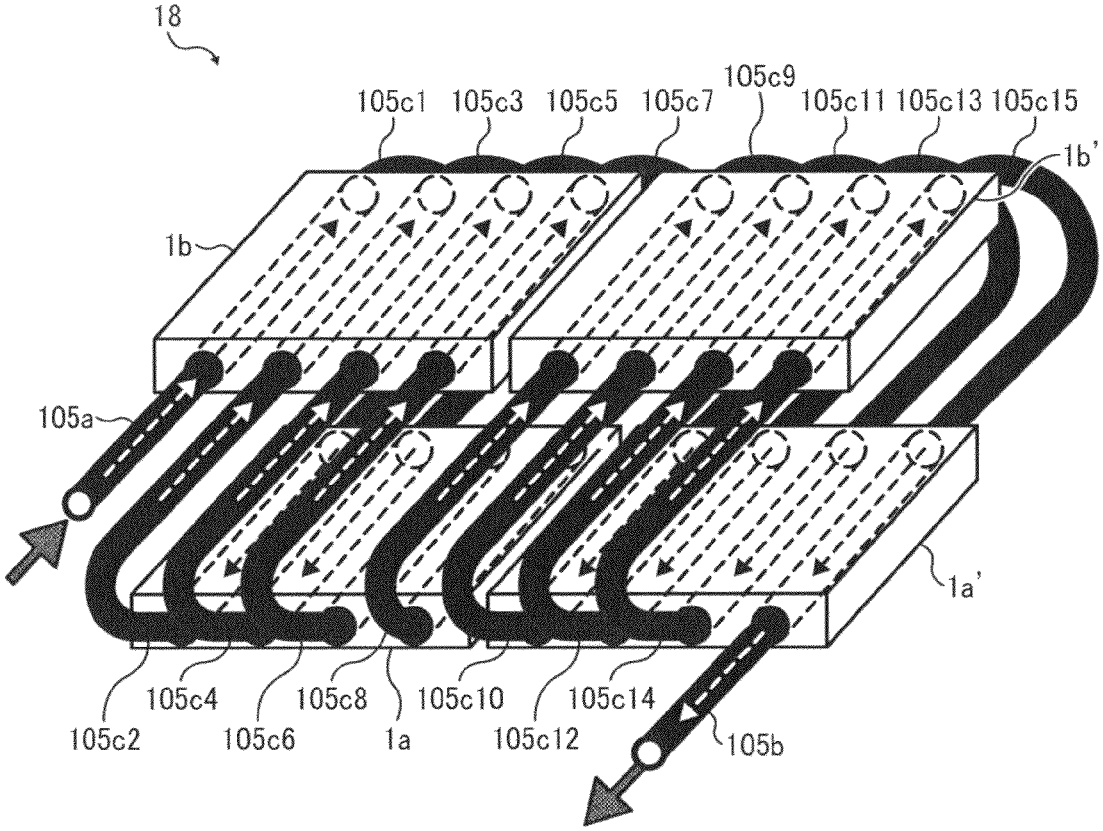
FIG. 24 is a schematic view illustrating an example of a configuration around cooling plates included in the cooling device illustrated in FIG. 23.

As illustrated in FIG. 24, the liquid coolant enters the cooling plate 1*b* through the tube 105*a* connected to the downstream end on the lateral surface of the cooling plate 1*b*, and alternately flows between the cooling plates 1*b* and 1*a* in a spiral manner through the tubes 105*c*1 to 105*c*7 from downstream to upstream. Next, the liquid coolant discharged from the cooling plate 1*a* is conveyed to the cooling plate 1*b*' via a tube 105*c*8, one end of which is connected to the upstream end on the lateral surface of the cooling plate 1*a* and the other end of which is connected to the downstream end on the lateral surface of the cooling plate 1*b*'. Thereafter, the liquid coolant alternately flows between the cooling plates 1*b*' and 1*a*' in a spiral manner through tubes 105*c*9 to 105*c*15 from downstream to upstream, and is ultimately discharged from the cooling plate 1*a*' to the tube 105*b* connected to the upstream end on the lateral surface of the cooling plate 1*a*'.

As a result, the temperature of each of the cooling plates 1*a* and 1*b* is further reduced at the downstream end of each of the cooling plates 1*a* and 1*b*. In addition, a difference in temperature between each of the cooling plates 1*a* and 1*b* and the cooling plates 1*a*' and 1*b*' can be reduced, thereby evenly cooling both the upper and lower surfaces of the sheet P.

Further, thermal transmission from the cooling plate 1*b*' or 1*a*' provided upstream from the cooling plate 1*b* or 1*a* to the cooling plate 1*b* or 1*a* can be prevented. Accordingly, a temperature increase in the downstream end of the cooling plate 1*a* or 1*b* can be prevented. As a result, a temperature increase in the liquid coolant flowing through the downstream end of each of the cooling plates 1*a* and 1*b*, which cools the sheet P in the last stage of cooling operation, can be prevented, thereby efficiently and effectively cooling the sheet P even at the downstream end of each of the cooling plates 1*a* and 1*b*.

Elements and/or features of different illustrative embodiments may be combined with each other and/or substituted for each other within the scope of this disclosure and appended claims.

Illustrative embodiments being thus described, it will be apparent that the same may be varied in many ways. Such exemplary variations are not to be regarded as a departure from the scope of the present invention, and all such modifications as would be obvious to one skilled in the art are intended to be included within the scope of the following claims.

The number of constituent elements and their locations, shapes, and so forth are not limited to any of the structure for performing the methodology illustrated in the drawings.

What is claimed is:

1. A cooling device, comprising:

a first belt;

a second belt to convey a sheet together with the first belt;

at least one cooler contacting an inner circumferential surface of the first belt to cool the sheet via the first belt, and the cooler includes:

an inlet, an outlet, the inlet shifted from the outlet in a sheet conveyance direction, a plurality of internal channels disposed inside the cooler, and a communication channel connecting adjacent internal channels; and at least one roller contacting an inner circumferential surface of the second belt and disposed opposite the cooler member via the first belt and the second belt, wherein a liquid coolant enters the cooler through the inlet and is discharged from the cooler through the outlet.

2. The cooling device according to claim 1, wherein the roller is disposed opposite a center of the cooler in a sheet conveyance direction.

3. The cooling device according to claim 1, wherein the roller presses the first belt and the second belt against the cooler.

4. The cooling device according to claim 1, further comprising a drive roller to drive the first belt, wherein the roller is smaller than the drive roller in diameter.

5. The cooling device according to claim 1, further comprising a drive roller to drive the second belt, wherein the roller is smaller than the drive roller in diameter.

6. The cooling device according to claim 1, wherein the internal channels extend in a direction perpendicular to a sheet conveyance direction, and wherein the roller extends in the direction in which the internal channel extend.

7. The cooling device according to claim 1, wherein the first belt and the second belt are formed of one of an elastic material of acrylic rubber and polyimide.

8. The cooling device according to claim 7, wherein the first belt and the second belt include a multi-layered structure formed of the elastic material and polyimide.

9. The cooling device according to claim 1, wherein the cooler includes a plate shape.

10. The cooling device according to claim 9, wherein the cooler includes a heat-absorbing surface having an even curvature radius.

11. The cooling device according to claim 1, wherein the cooler includes a plurality of coolers arranged in a sheet conveyance direction.

12. A cooling device, comprising:

a first belt;

a second belt to convey a sheet together with the first belt;

at least one cooler contacting an inner circumferential surface of the first belt to cool the sheet via the first belt, and the cooler includes:

an inlet projecting from a lateral surface of the cooler, an outlet projecting from the lateral surface of the cooler, and a frame contacting the lateral surface provided with the inlet and the outlet of the cooler, the frame including:

an inlet opening through which the inlet is inserted, and an outlet opening through which the outlet is inserted; and at least one roller contacting an inner circumferential surface of the second belt and disposed opposite the cooler via the first belt and the second belt.

13. The cooling device according to claim 12, wherein the frame positions the lateral surface of the cooler.

14. The cooling device according to claim 13, wherein the frame is disposed outside both edges of the first belt in a width direction of the first belt.

15. An image forming apparatus, comprising:

a fixing device to fix a toner image on a sheet; and a cooling device disposed downstream from the fixing device in a sheet conveyance direction, the cooling device according to claim 1.

16. A cooling device, comprising:

a first belt;

a second belt to convey a sheet together with the first belt;

at least one cooler contacting an inner circumferential surface of the first belt to cool the sheet via the first belt, and the cooler includes:

an inlet projecting from a lateral surface of the cooler, an outlet projecting from the lateral surface of the cooler, and a frame contacting an opposite lateral surface opposite the lateral surface provided with the inlet and the outlet of the cooler; and at least one roller contacting an inner circumferential surface of the second belt and disposed opposite the cooler via the first belt and the second belt.

17. An image forming apparatus, comprising:

a fixing device to fix a toner image on a sheet; and a cooling device disposed downstream from the fixing device in a sheet conveyance direction, the cooling device according to claim 12.

18. An image forming apparatus, comprising:

a fixing device to fix a toner image on a sheet; and a cooling device disposed downstream from the fixing device in a sheet conveyance direction, the cooling device according to claim 16.

* * * * *

UNITED STATES PATENT AND TRADEMARK OFFICE

CERTIFICATE OF CORRECTION

PATENT NO. : 9,098,024 B2
APPLICATION NO. : 14/243561
DATED : August 4, 2015
INVENTOR(S) : Keisuke Ikeda It is certified that error appears in the above-identified patent and that said Letters Patent is hereby corrected as shown below:

IN THE CLAIMS

In column 22, line 29, cancel the text "member" from Claim 1.

Signed and Sealed this
Fifth Day of January, 2016

Michelle K. Lee

Michelle K. Lee
*Director of the United States Patent and Trademark Office*